US008538290B2

(12) United States Patent
Okamoto

(10) Patent No.: US 8,538,290 B2
(45) Date of Patent: Sep. 17, 2013

(54) IMAGE FORMING APPARATUS WITH DETACHABLE CONSTITUENT COMPONENT AND HOLDING PART

(75) Inventor: Masaya Okamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 448 days.

(21) Appl. No.: 12/883,914

(22) Filed: Sep. 16, 2010

(65) Prior Publication Data

US 2011/0229198 A1 Sep. 22, 2011

(30) Foreign Application Priority Data

Mar. 17, 2010 (JP) ..... 2010-060967

(51) Int. Cl.
*G03G 15/00* (2006.01)
*G03G 15/08* (2006.01)

(52) U.S. Cl.
USPC ..... 399/110; 399/120

(58) Field of Classification Search
USPC ..... 399/107, 110, 120, 123
See application file for complete search history.

(56) References Cited

FOREIGN PATENT DOCUMENTS

JP 2005-077615 A 3/2005
JP 2006-267402 A 10/2006

*Primary Examiner* — David Gray
*Assistant Examiner* — Andrew Do
(74) *Attorney, Agent, or Firm* — Sughrue Mion, PLLC

(57) ABSTRACT

An image forming apparatus includes a holding part that holds a detachable constituent component so that the detachable component is displaced to a detachment operating position and primary and secondary mounting completed positions as a result of link with opening/closing operations of an opening/closing part, and a connection part that is provided on the opening/closing part and in which a guide groove is formed which guides a projecting portion provided on the holding part. The guide groove of the connection part includes a narrow portion through which the projecting portion is caused to pass while the detachable constituent component is being displaced from the detachment operating position to the primary or secondary mounting completed position. The narrow portion has a groove width which is narrower than an outer dimension of the projecting portion.

3 Claims, 21 Drawing Sheets

IN FULL COLOR MODE

IN MONOCHROME MODE

IN FULL COLOR MODE

IN MONOCHROME MODE

IMAGE FORMING APPARATUS WITH DETACHABLE CONSTITUENT COMPONENT AND HOLDING PART

CROSS-REFERENCE TO RELATED APPLICATIONS

This application is based on and claims priority under 35 USC 119 from Japanese Patent Application No. 2010-060967 filed on Mar. 17, 2010.

BACKGROUND

1. Technical Field

The present invention relates to an image forming apparatus.

2. Related Art

Some of image forming apparatuses such as printers and photocopiers which form images adopt a mechanism which is linked with an opening/closing cover provided on a main body of the apparatus so as to change states of a constituent component (a detachable constituent component) which is placed in an interior of the main body in accordance with an opening or closing operation of the opening/closing cover.

SUMMARY

According to an aspect of the invention, an image forming apparatus includes an apparatus main body, a detachable constituent component, an opening/closing part, a holding part and a connection part. The apparatus main body includes an opening portion. The detachable constituent component is detachably mounted in an interior of the apparatus main body through the opening portion. The opening/closing part opens/closes the opening portion of the apparatus main body when the detachable component is attached/detached. The holding part holds the detachable constituent component so that the detachable component is displaced to a detachment operating position and primary and secondary mounting completed positions as a result of link with opening/closing operations of the opening/closing part. The holding part changes positions between the primary mounting completed position and the secondary completed position by being moved in the interior of the apparatus main body. The connection part is provided on the opening/closing part and in which a guide groove is formed which guides a projecting portion provided on the holding part when the detachable constituent component is being displaced from the detachment operating position to the primary or secondary mounting completed position. The guide groove of the connection part includes a narrow portion through which the projecting portion is caused to pass while the detachable constituent component is being displaced from the detachment operating position to the primary or secondary mounting completed position. The narrow portion has a groove width which is narrower than an outer dimension of the projecting portion.

BRIEF DESCRIPTION OF THE DRAWINGS

Exemplary embodiment(s) of the present invention will be described in detail based on the following figures, wherein:

FIGS. 5A and 5B show explanatory diagrams showing a displacement mechanism of an intermediate transfer unit, of which FIG. 5A shows a state of a displacement position at the time of a full color mode, and FIG. 5B shows a state of a displacement position at the time of a monochrome mode;

FIGS. 10A and 10B show perspective views of the developer recovery container, of which FIG. 10A is a perspective view showing an external appearance of the developer recovery container when an opening/closing shutter is in a position where it closes opening portions, and FIG. 10B is a perspective view showing an external appearance of the developer recovery container when the opening/closing shutter is in a position where it opens the opening portions;

FIGS. 19A and 19B show explanatory diagrams showing an opening operation of the opening/closing cover and a displaced state of the movable holder at the time of the full color mode, of which FIG. 19A shows a state of an intermediate stage of the opening operation, and FIG. 19B shows a state in which the opening/closing cover is opened fully and the movable holder is displaced to a detaching operation position;

FIGS. 20A and 20B show explanatory diagrams showing a closing operation of the opening/closing cover and a displaced state of the movable holder at the time of the full color mode, of which FIG. 20A shows a state of an intermediate stage of the closing operation, and FIG. 20B shows a state in which the opening/closing cover is closed fully and the movable holder is displaced to a first mounting completed position;

FIGS. 21A and 21B show explanatory diagrams showing an opening operation of the opening/closing cover and a displaced state of the movable holder at the time of the monochrome mode, of which FIG. 21A shows a state of an intermediate stage of the opening operation, and FIG. 21B shows a state in which the opening/closing cover is opened fully and the movable holder is displaced to a detaching operation position; and FIGS. 22A and 22B show explanatory diagrams showing a closing operation of the opening/closing cover and a displaced state of the movable holder at the time of the monochrome mode, of which FIG. 22A shows a state of an intermediate stage of the closing operation, and FIG. 22B shows a state in which the opening/closing cover is closed fully and the movable holder is displaced to a second mounting completed position.

DETAILED DESCRIPTION

Hereinafter, a mode for carrying out the invention (hereinafter, referred to simply as an "exemplary embodiment") will be described by reference to the accompanying drawings.

Figure 1:
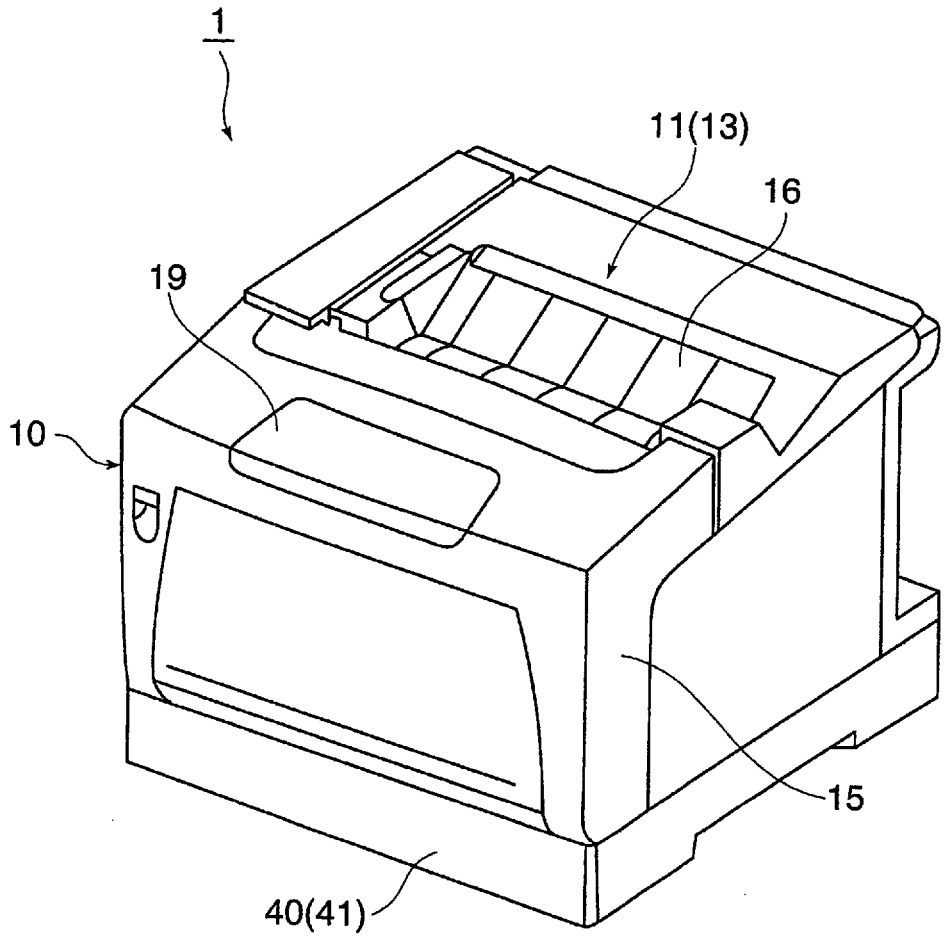
FIG. 1 is a perspective view showing an external appearance of an image forming apparatus according to a first exemplary embodiment.
Figure 2:
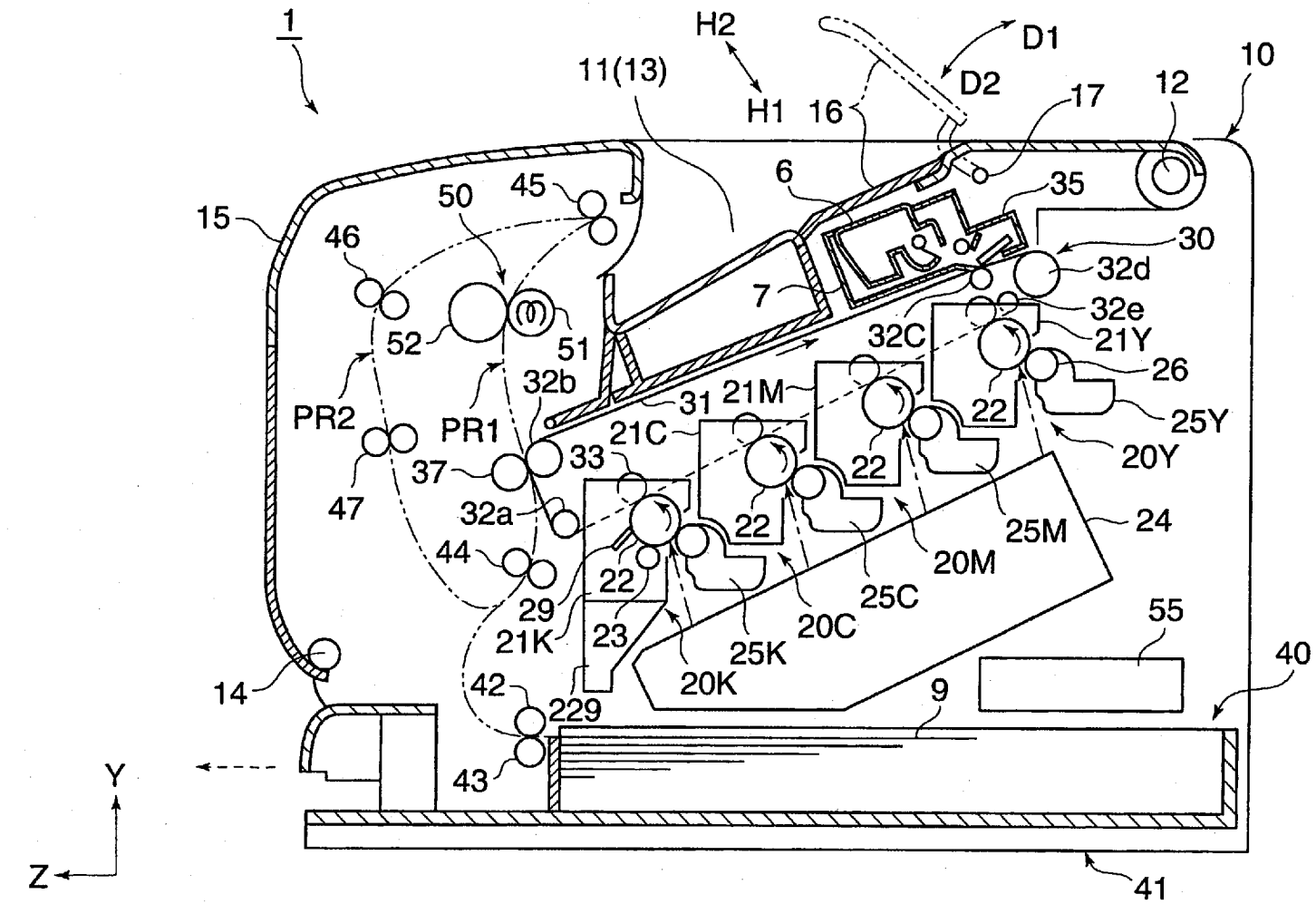
FIG. 2 is a schematic sectional view showing a main part of the image forming apparatus shown in FIG. 1.
Figure 3:
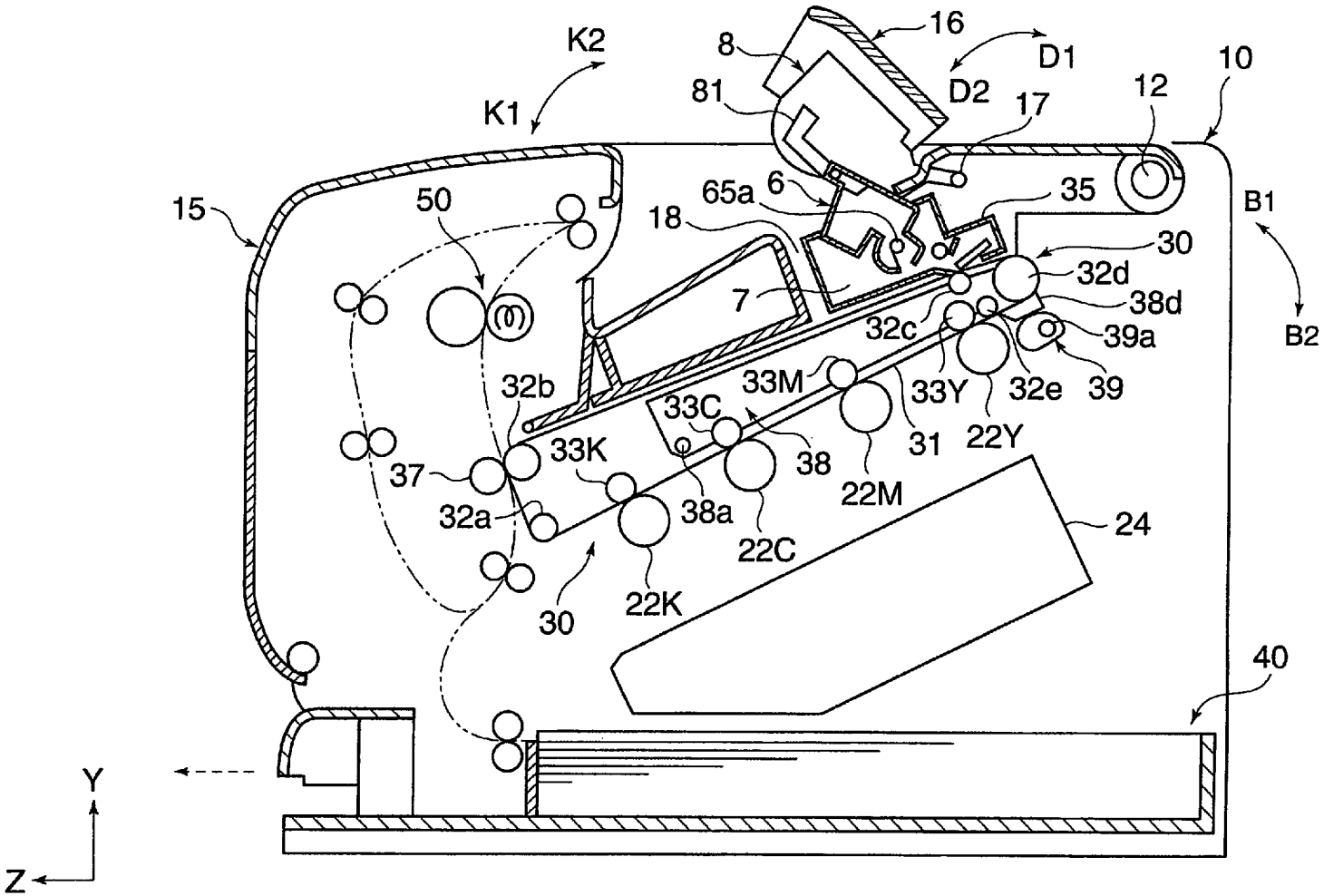
FIG. 3 is a schematic sectional view showing one state (a state in which an opening/closing cover is opened) of the image forming apparatus shown in FIG. 2.

FIGS. 1 to 3 show an image forming apparatus 1 according to a first exemplary embodiment. FIG. 1 is a perspective view showing an external appearance of the image thrilling apparatus 1, FIG. 2 is a sectional view showing a main part of the image forming apparatus, and FIG. 3 is an explanatory diagram showing a state of the image forming apparatus 1 (a state in which a developer recovery container is mounted or removed by opening one of opening/closing covers).

The image forming apparatus 1 has an apparatus main body 10 which includes a support member, an exterior covering and the like. A sheet feeding unit 40 is disposed at a lower portion of the apparatus main body 10. This sheet feeding unit 40 stores recording sheets 9 as recording media on which images are to be formed and feeds them. A sheet discharge and accumulation part 11 is formed at an upper portion of the apparatus main body 10. Sheets on which images have been formed are discharged and accumulated on to the sheet discharge and accumulation part 11.

As is shown in FIGS. 2, 3 and the like, part of the apparatus main body which configures the sheet discharge and accumulation part 11 is configured as an upper opening/closing portion 13 which swings outwards about a first hinge (shall) 12 as a fulcrum to open part of the upper portion of the apparatus main body 10. A lateral side portion which configures one lateral side of the apparatus main body 10 (a lateral side making a front side of the apparatus) is, as will be described later, configured as a side opening/closing portion 15 which swings outwards via a second hinge 14 to open. In addition, the upper opening/closing portion 13 is configured as a plate-like opening/closing cover 16 which can be opened when a removal operation of a developer recovery container (6) is performed at the part which constitutes the sheet discharge and accumulation part 11. As will be described later, the opening/closing cover 16 swings about a shaft 17 which is positioned slightly spaced away therefrom via a support arm 161 so as to open or close. In FIG. 1, reference numeral 19 denotes a control panel portion where control knobs, a display portion and the like are disposed. In FIG. 2, reference numeral 18 denotes an opening portion in the apparatus main body 10 which is opened or closed by the opening/closing cover 16.

The sheet feeding unit 40 has a sheet storage member 41 which stores a pile of recording sheets 9 which are laid one on top of another. The sheet storage member 41 is constructed so as to be pulled out from a front side of the apparatus main body 10 (In FIG. 2, a left-hand side of the apparatus main body 10: in a direction indicated by an arrow attached to a dotted line), and recording sheets 9 are refilled into the sheet storage member 41 which is pulled out of the sheet feeding unit 40. A feed roller 42 is disposed above one end portion of the sheet storage member 41 so as to contact a topmost sheet of the pile of recording sheets 9. A separation roller 43 is disposed opposite the feed roller 42.

In the sheet feeding unit 40, the topmost sheet of the pile of recording sheets stored in the sheet storage member 41 is fed out by the feed roller 42 and is then separated from a recording sheet lying underneath the topmost sheet by the separation roller 43 in cooperation with the feed roller 43. Sheets 9 are sent out sheet by sheet in this way by the feed roller 42 and the separation roller 43. The sheet 9 so sent out is temporarily stopped by a transport adjusting roller 44 and is then transported between an intermediate transfer unit 30, which will be described later, and a secondary transfer unit 37 (a secondary transfer position) at a required timing.

Image forming units 20 as image forming means, the intermediate transfer unit 30, the secondary transfer unit 37, a fixing unit 50 and the like are disposed in an interior of a housing which is configured by the apparatus main body 10. The image forming units 20 include four image forming units 20Y, 20M, 20C, 20K which form developer (toner) images of four colors of yellow (Y), magenta (M), cyan (C) and black (K), respectively. The image forming units 20 (Y, M, C, K) in the first exemplary embodiment are disposed in such a state that their positions get higher gradually (or inclined) in the order of black, cyan, magenta and yellow, excluding an optical writing unit (24), which will be described later.

The image forming units 20 (Y, M, C, K) include photosensitive drum units 21 (Y, M, C, K) which are detachably mounted in the apparatus main body 10 for use, the optical writing unit 24 as a latent image forming means and a plurality of developing units 25 (Y, M, C, K). Each of the photosensitive drum units 21 (Y, M, C, K) is configured as an easily detachable component by integrating a photosensitive drum 22 which rotates in a required direction, a charger 23 for charging a surface (a photosensitive layer) of the photosensitive drum 22 to a required potential and a cleaner 29 for removing unnecessary substances such as toner which remains on the surface of the photosensitive drum 22 into a single unit, as is shown in FIG. 3. In FIG. 2, the charger 23 and the cleaner 29 are shown on the black photosensitive drum unit 21K only to represent the four photosensitive drum units 21.

In any of the photosensitive drum units 21 (Y, M, C, K), the photosensitive drum 22 is mounted rotatably in an interior of a housing-like unit main body which is opened partially. In addition, in the interior of the unit main body, a charging roller as the charger 23 is mounted so as to be driven while being in contact with the surface (a circumferential surface) of the photosensitive drum 22, and an elastic blade as the cleaner 29 is mounted so as to be in contact with the surface of the photosensitive drum 22. The photosensitive drum 22 is made to rotate in a direction indicated by an arrow by a rotating force transmitted thereto from a driving unit, not shown, in such a state that the drum unit 21 is mounted in the apparatus main body 10.

In each photosensitive drum unit 21, the surface of the rotating photosensitive drum 22 is charged to a desired potential by the charger 23, and the surface of the photosensitive drum 22 is cleaned by the cleaner 29 after a primary transfer, which will be described later, has been performed thereon. A vacant space existing below a unit main body 210 is made use of as a recovery space where to recover unnecessary substances such as toner removed by the cleaner 29. Reference numeral 229 in FIG. 2 denotes a developer recovery container where to recover residual developer that is discharged from each developing unit 25.

The optical writing unit 24 is disposed in a position lying below the four image forming units 20 (Y, M, C, K). The optical writing unit 24 includes a light source such as a semiconductor laser and optical components such as lenses and mirrors which guide light emitted from the light source to the photosensitive drums 22 for scanning in an interior of a housing which is shielded so as not to transmit light, the light source and the optical components not being shown in the figure. In the optical writing unit 24, light of each color component (indicated by a chain line with an arrow) that is produced based on image information is shone on to the charged photosensitive drum 22 in each photosensitive drum unit 21 to thereby form a latent image of each color. Light exit portions, not shown, are formed in an upper side of the housing of the optical writing unit 24 so as to match light shining positions of the respective photosensitive drums 22 so that light that forms latent images is emitted to the light shining positions.

The developing units 25 (Y, M, C, K) are disposed so that they exist between the photosensitive drum units 21 (Y, M, C, K) and the optical writing unit 24. Each of the developing units 25 has a developing roller 26 which rotates in such a state that the developing roller 26 faces the corresponding photosensitive drum 22 with a required space provided therebetween. The developing unit 25 holds a developer of a required color component on its developing roller 26 and supplies the developer to a development zone which faces the corresponding photosensitive drum 22 to develop (visualize) an electrostatic latent image that is formed on the corresponding photosensitive drum 22 by the developer. Namely, this process is done at each developing unit to form four toner images of the respective colors which are made up of the respective developers (toners). The corresponding developer is supplied to each developing unit 25 from a corresponding developer supply unit, not shown, depending upon consumption of the developer.

The intermediate transfer unit 30 has an endless intermediate transfer belt 31 on to whose outer circumferential surface the toner images formed on the respective photosensitive drums 22 of the image forming units 20 (Y, M, C, K) are transferred, a plurality of support rollers 32*a*, 32*b*, 32*c*, 32*d*, 32*e* which extend the intermediate transfer belt 31 so as to be wound therearound in a contact state and rotate the same belt in a direction indicated by an arrow, and primary transfer units 33 which primarily transfer the toner images on the respective photosensitive drums 22 to the outer circumferential surface of the intermediate transfer belt 31.

In the plurality of support rollers, the support roller 32*b* is a drive roller to which a rotating force is transmitted from a rotating drive unit, not shown, so as to rotate the intermediate transfer belt 31 in the direction indicated by the arrow. The primary transfer units 33 are disposed so as to be brought into contact with an inner circumferential surface of the intermediate transfer belt 31 to press the outer circumferential surface of the belt 31 against respective surfaces of the photosensitive drums 22 and are made up of primary transfer rollers 33 to which a primary transfer bias voltage is applied.

Figure 4:
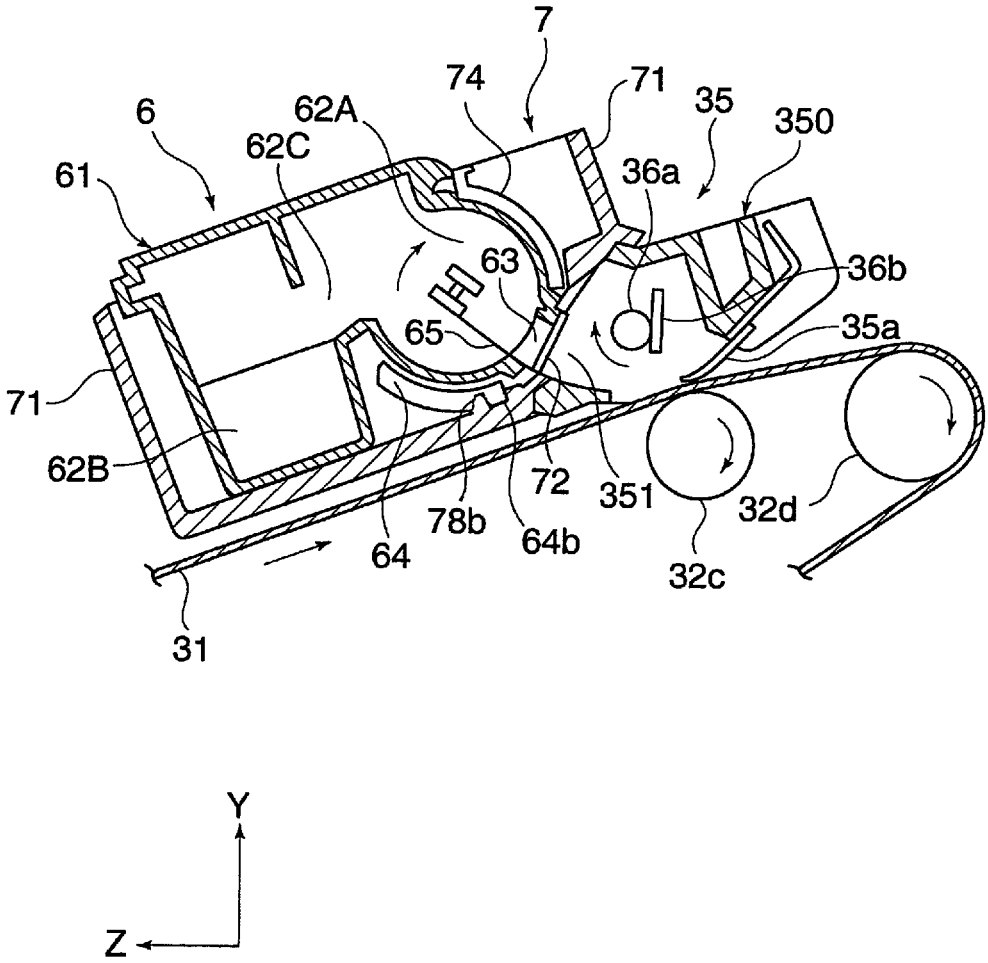
FIG. 4 is a schematic sectional view showing a belt cleaner, a developer recovery container and a mounting and holding frame of the developer recovery container in the image forming apparatus shown in FIG. 1.

In addition, as is shown in FIGS. 2 to 4, a belt cleaner 35 is mounted on the intermediate transfer unit 30 for removing unnecessary substances such as toner remaining the outer circumferential surface of the intermediate transfer belt 31. The belt cleaner 35 includes an elastic blade 35*a* which is attached to its cleaner main body (a housing) 350 so as to be brought into contact with the outer circumferential surface of the intermediate transfer belt 31 to scrape unnecessary substances such as toner thereof for removal. The elastic blade 35*a* is disposed so as to be brought into contact with an outer circumferential surface portion of the intermediate transfer belt 31 which is supported by the support roller 32*c* (strictly speaking, an overall area in a direction which indicates a width W1 which is at right angles to the rotating direction of the belt 31).

In addition, as is shown in FIGS. 2, 4 and the like, a developer recovery container 6 is added to the belt cleaner 35 for recovering the unnecessary substances such as toner which are removed by the elastic blade 35*a*. Because of this, the belt cleaner 35 includes a transport member 36 which transports the unnecessary substances such as toner which are removed by the elastic blade 35*a* to hand them over into the developer recovery container 6 through a discharge port 351 that is formed in the cleaner main body 350. The discharge port 351 is formed as an opening portion having a length which is substantially the same as the width W1 of the intermediate transfer belt 31. The transport member 36 is such that an elastic sheet 36*b* is attached to a rotating shall 36*a* which rotates in a direction indicated by an arrow in such a stale that one end of the elastic sheet 36*b* constitutes a free end, for example. This transport member 36 rotates about the rotating shaft 36*a* in the direction indicated by the arrow to thereby transport the unnecessary substances such as toner that is recovered by the elastic sheet 36 towards the discharge port 351. Incidentally, the developer recovery container 6 is detachably mounted in a mounting and holding frame 7 for use. The details of the developer recovery container 6 and the mounting and holding frame 7 will be described later.

The intermediate transfer unit 30 (including the belt cleaner 35) is integrally attached to a rear surface side of the upper opening/closing portion 13 which constitutes a part of the sheet discharge and accumulation part 11. By adopting this configuration, the intermediate transfer unit 30 swings about the primary hinge 12 as a fulcrum so as to be displaced to a position which is shifted outwards of the apparatus main body 10 when the upper opening/closing portion 13 is operated to open. By this intermediate transfer unit 30 being shifted outwards of the apparatus main body 10, the four photosensitive drum units 21 are exposed to the outside of the apparatus main body 10, whereby the photosensitive drum units 21 can easily be dismounted from the apparatus main body 10 for replacement or refill of toners.

The secondary transfer unit 37 secondarily transfers the toner images which are primarily transferred on to the outer circumferential surface of the intermediate transfer belt 31 on to a recording sheet 9. The secondary transfer unit 37 is disposed so as to be brought into contact with the outer circumferential surface of a portion of the intermediate transfer belt 31 which is wound around the support roller 32*b* that functions as the drive roller to thereby be driven to rotate and is made up of a secondary transfer roller 37 to which a secondary transfer bias voltage is applied. When forming an image, a toner image made up of the toner images of the plurality of colors which are stacked one on top of another on the intermediate transfer belt 31 or a toner image of a single color is primarily transferred to the secondary transfer roller 37.

The fixing unit 50 fixes the toner image that has been secondarily transferred on to the recording sheet 9 and which has not yet been fixed to the recording sheet 9 and is disposed in a position which lies above the secondary transfer unit 37. The fixing unit 50 includes a heating rotary member 51 that has a fixing surface which is heated to a required temperature by a heating unit and which takes a roller form or a belt form and a pressing rotary member 52 that defines a fixing part which is brought into contact with the fixing surface of the heating rotary member 51 under a required pressure to allow the passage of the recording sheet 9 having the unfixed toner image (an object to be fixed) and which takes a roller form or a belt form. The recording sheet 9 having the unfixed toner image is caused to pass through a fixing process portion defined between the heating rotary member 51 and the pressing rotary member 52 to thereby be heated and pressed, whereby the unfixed toner image is fused so as to be fixed on to the recording sheet 9.

In addition to a primary transport path PR1 along which the recording sheet 9 is transported, a reverse transport path PR2 is formed in the interior of the apparatus main body 10. Incidentally, in the apparatus main body 10, a portion which is disposed outwards of the reverse transport path PR2 and the exterior covering are divided along the reverse transport path PR2 and a portion of the exterior covering member that is so divided is configured as a side opening/closing portion 15 which swings outwards via a secondary hinge 14 to open. In addition, the opening operation of the upper opening/closing portion 13 which constitutes part of the sheet discharge and accumulation part 11 is performed after the side opening/closing portion 15 is put in W an open state.

The primary transport path PR1 is used to transport the recording sheet 9 supplied from the sheet feeding unit 40 to the transfer and fixing positions of toner images and to discharge the recording sheet 9 on to which the image is formed and fixed into the sheet discharge and accumulation part 11. A discharge roller 45 is disposed between the fixing unit 50 on the primary transport path PR1 and a discharge port 11*a* which is formed directly before the sheet discharge and accumulation part 11.

The reverse transport path PR2 is a transport path that is used to transport again the recording sheet 9 on one side of which the image is formed to a secondary transfer position which is part of the image forming part in such a state that the recording sheet 9 is turned inside out. For example, two transport rollers 46, 47 are disposed on a portion of the reverse transport path PR2 which extends from the discharge roller 45 to a position which lies directly before the transport adjusting roller 44 and where the reverse transport path PR2 merges into the primary transport path PR1. In this reverse transport path PR2, the discharge roller 45 is caused to rotate reversely at a point in time when a rear end portion of the recording sheet 9 on which the image is formed is pinched by the discharge roller 45, so that the recording sheet 9 is transported so as to be handed over to the transport rollers 46, 47 sequentially and is eventually transported to an upstream position of the transport adjusting roller 44.

A power supply unit 55 is disposed in the interior of the apparatus main body. A required voltage (current) is applied from the power supply unit 55 to objects to be electrically fed such as the charger 23, the image writing unit 24, the developing rollers 26 of the developing units 25, the primary transfer rollers 33, the secondary roller 37 and the fixing unit 50.

In this image forming apparatus 1, the photosensitive drum units 21 (Y, M, C, K) are mounted or removed therefrom with the upper opening/closing portion 13 kept opened. The side opening/closing portion 15 is opened before the upper opening/closing portion 13 is opened. With the upper opening/closing portion 13 kept opened, the photosensitive drum units 21 (Y, M, C, K) are exposed to the outside of the image forming apparatus 1, whereby the photosensitive drum units 21 are lifted upwards to be removed therefrom for maintenance or replacement. In addition, the developer recovery unit 6 is mounted or removed from the image forming apparatus 1 after the opening/closing cover 16, which constitutes part of the upper opening/closing portion 13, is put in an opened state as will be described later (FIG. 3).

The image forming apparatus 1 can form a full color image by use of the developers (toners) of yellow (Y), magenta (M), cyan (C) and black (K), as well as a black and white image by use of the developer of black (K).

Here, in the case of an image forming operation for forming a full color image (a full color mode), all the respective photosensitive drums 22 (Y, M, C, K) of the photosensitive drum units 21 (Y, M, C, K) are caused to rotate, and toner images of the respective colors are formed on the corresponding photosensitive drum units 21. Thereafter, the respective toner images are primarily transferred on to the intermediate transfer belt 31 which passes by the photosensitive drums 21 in such a state that the intermediate transfer belt 31 is in contact with the surfaces of the drums 21 by being pressed thereagainst from the inside thereof by the primary transfer rollers 33 so that the toner images are superimposed one on top of another, and the resulting toner image which is made up of the plurality of colors is then secondarily transferred on to the recording sheet 9. On the other hand, in the case of an image forming operation for forming a black and white image (a monochrome mode), the photosensitive drum 22 of black (K) is caused to rotate, and a toner image of black (K) is formed and primarily transferred on to the intermediate transfer belt 31 and the resulting toner image is finally secondarily transferred on to the recording sheet 9. However, in the monochrome mode, the other photosensitive drums 22 (Y, M, C) than the photosensitive drum 22 (K) which are not involved in forming the monochrome toner image are not caused to rotated. Because of this, in the image forming apparatus 1, a withdrawal mechanism is adopted which keeps the intermediate transfer belt 31 spaced apart from the surfaces of the photosensitive drums 21 (Y, M, C) which are kept stationary without rotating in the monochrome mode.

Figure 5A:
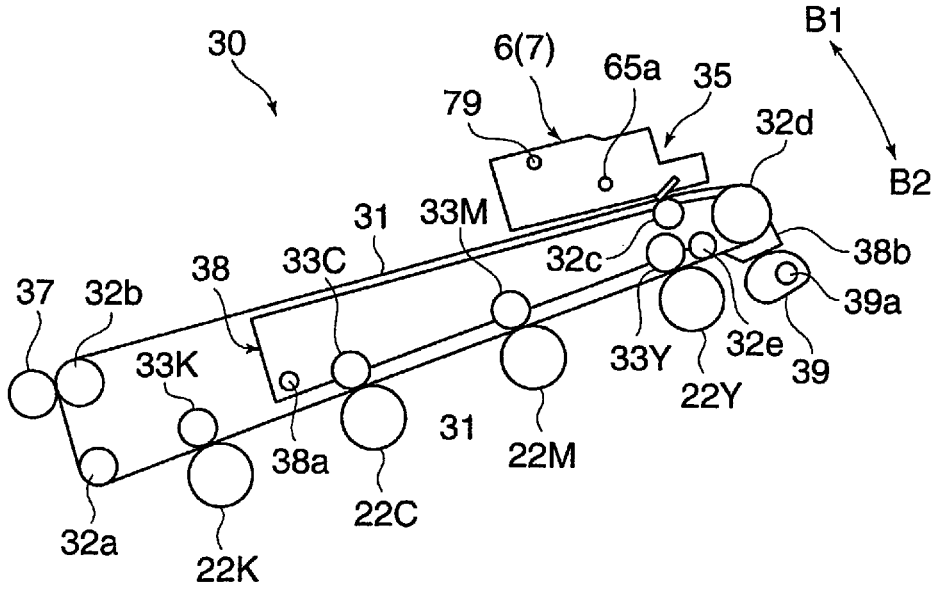
Figure 5B:
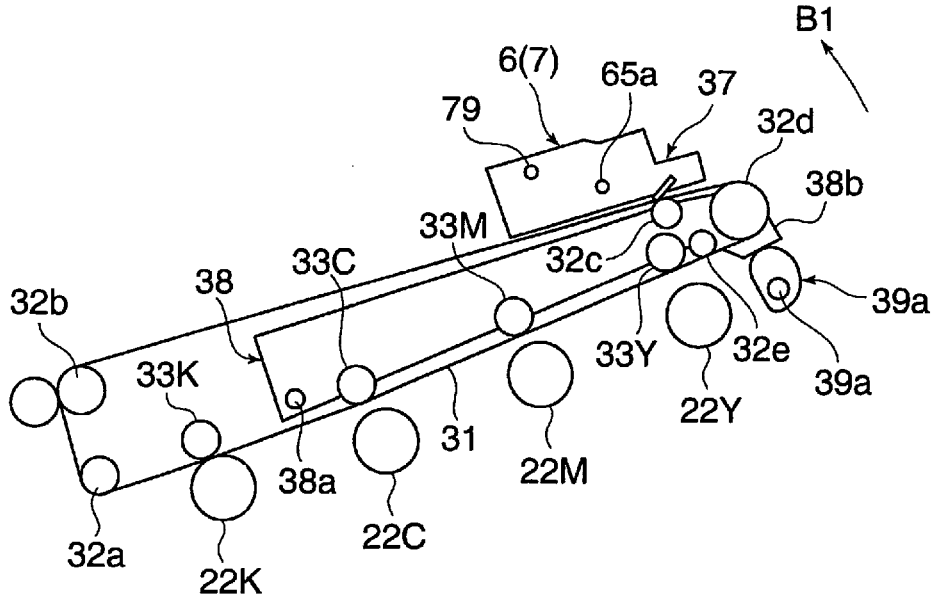

As is shown in FIGS. 3, 5A and 5B, in this withdrawal mechanism, the support rollers 32*c*, 32*d*, 32*e* which support the intermediate transfer belt 31 which is part of the constituent components of the intermediate transfer unit 30 and the primary transfer rollers 33 (Y, M, C) of yellow (Y), magenta (M) and cyan (C) are disposed on a movable frame 38 which swings in directions indicated by arrows B1, B2 about a pivot shaft 38*a* which is fixed to the apparatus main body 10. The movable frame 38 is supported by a cam 39 at its free end 38*b* and swings in the directions indicated by the arrows B1, B2 about the pivot shaft 38*a* by the cam 39 rotating by a predetermined angle about a pivot shall 39*a*.

Consequently, when the full color mode is selected, the withdrawal mechanism keeps the movable frame 38 in such a state that the same frame 38 is not swung in the direction indicated by the arrow B1 by the cam 39 as is shown in FIG. 5A, whereby the intermediate transfer belt 31 is kept in such a state that the same belt 31 is in contact with all the surfaces of the photosensitive drums 22 (Y, M, C, K). On the other hand, when the monochrome mode is selected, the withdrawal mechanism keeps the movable frame 38 in such a state that the same frame 38 is swung in the direction indicated by the arrow B1 by the cam 39 being rotated through a required angle as is shown in FIG. 5B, whereby the intermediate transfer belt 31 is kept from being brought into contact with any of the surfaces of the photosensitive drums 22 (Y, M, C, K) (or is kept in a withdrawn state).

Incidentally, this withdrawal mechanism keeps the intermediate transfer belt 31 in the mode (the full color mode or the monochrome mode) that was selected directly before the following image forming operation is performed, provided that no switching between the modes occurs in the following image forming operation. In addition, in the image forming apparatus 1, the belt cleaner 35, the developer recovery container 6 and the mounting and holding frame 7 of the same container 6 are placed on the movable frame 38. Because of this, as is shown in FIGS. 5A and 5B, when the movable frame 38 is displaced in the directions indicated by the arrows B1, B2, there are produced the mounting completed positions which are different from each other depending upon the position of the movable frame 38; the mounting completed position (a primary mounting completed position) when the full color mode is selected and the mounting completed position (a secondary mounting completed position) when the monochrome mode is selected (FIGS. 5A, 5B, 15, 16).

Next, the developer recovery container 6 and the mounting and holding frame 7 thereof will be described.

Figure 6:
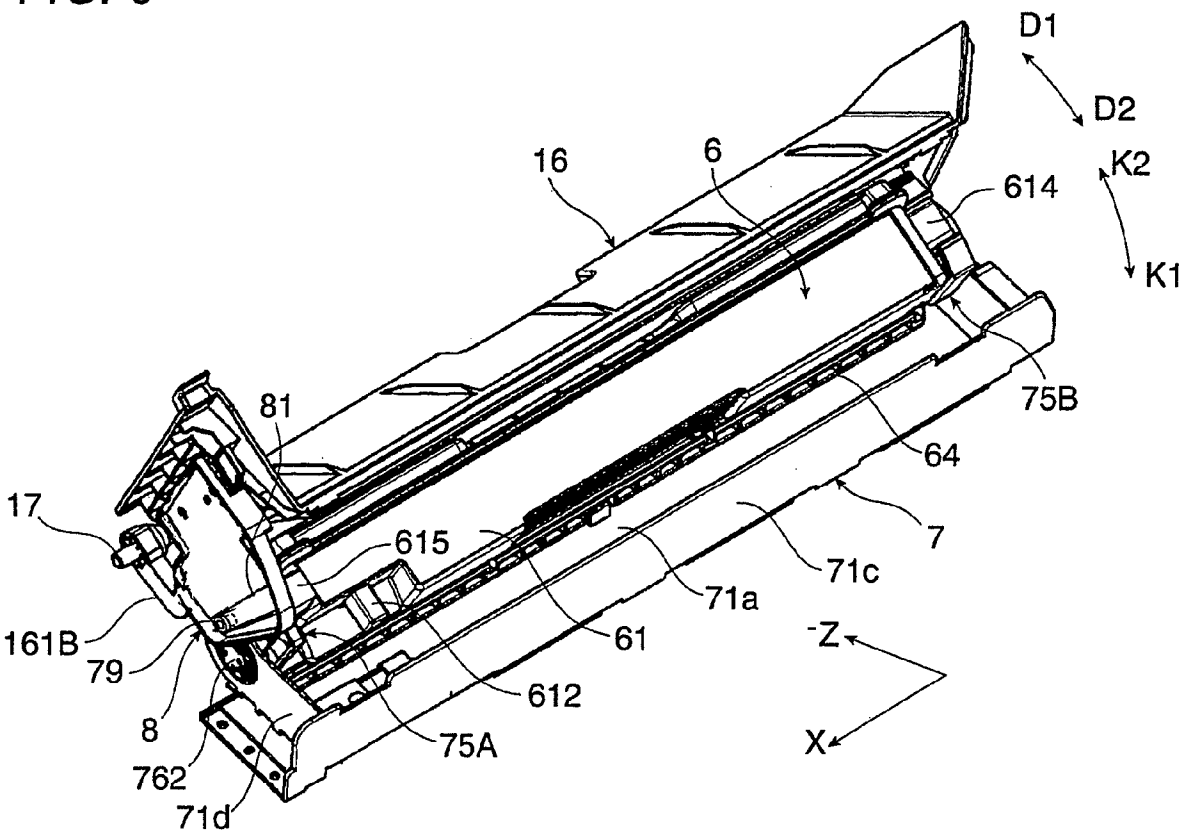
FIG. 6 is a perspective view showing configurations of an opening/closing cover, the developer recovery container and the mounting and holding frame.
Figure 7:
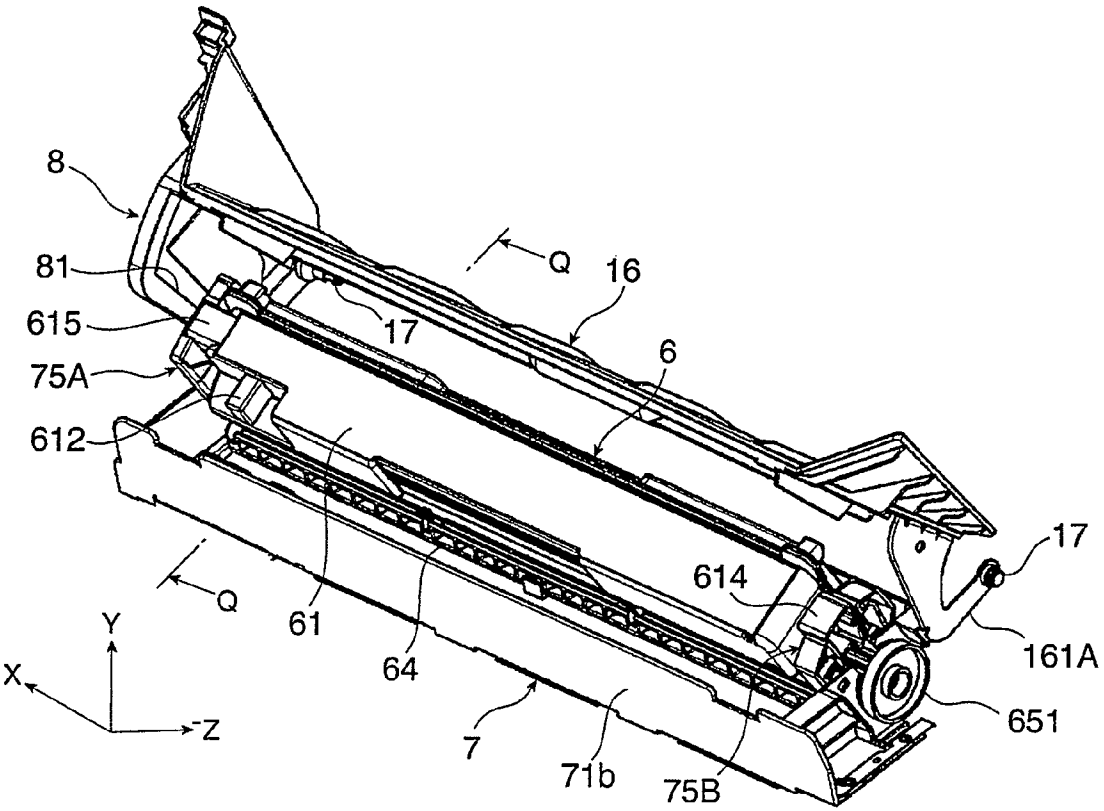
FIG. 7 is a perspective view showing a state in which the configurations of the opening/closing cover, the developer recovery container and the mounting and holding frame shown in FIG. 6 are viewed from a different direction.
Figure 8:
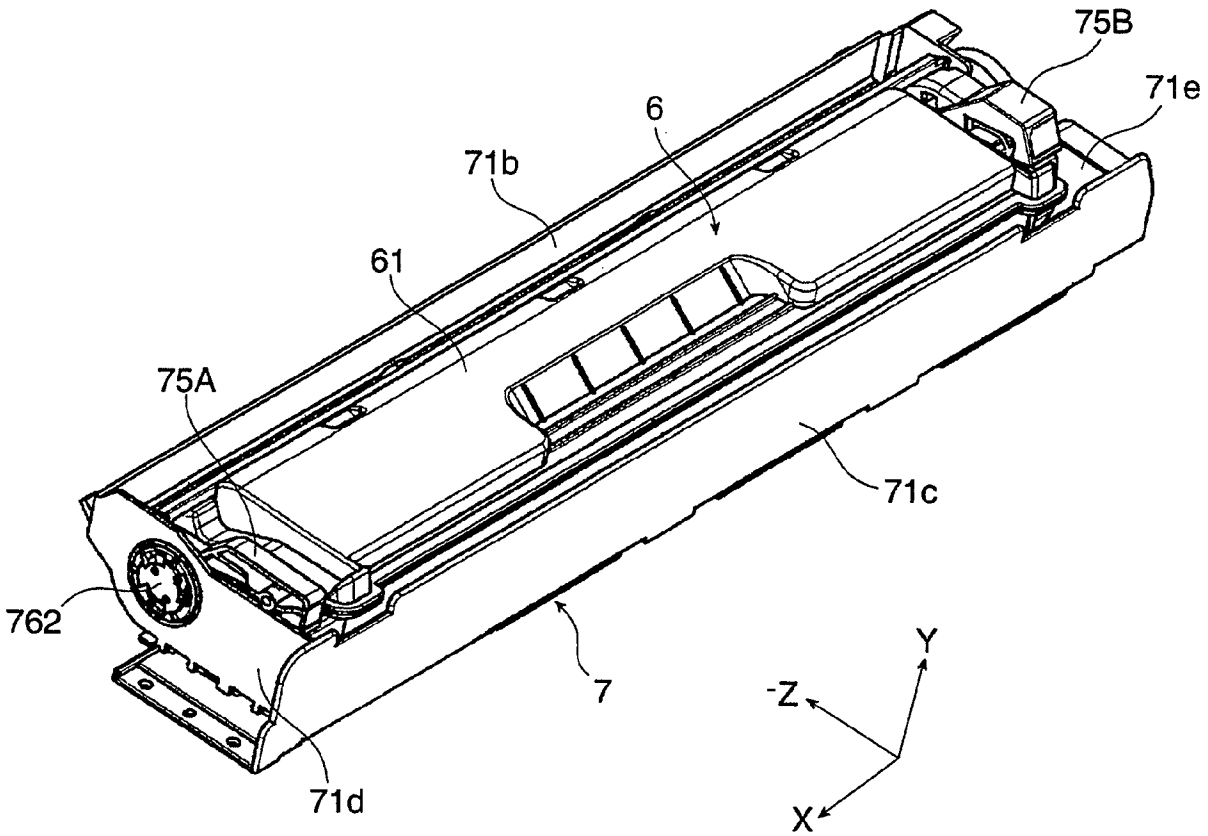
FIG. 8 is a perspective view showing a state in which the developer recovery container and a movable holder are displaced to a mounting completed position.
Figure 9:
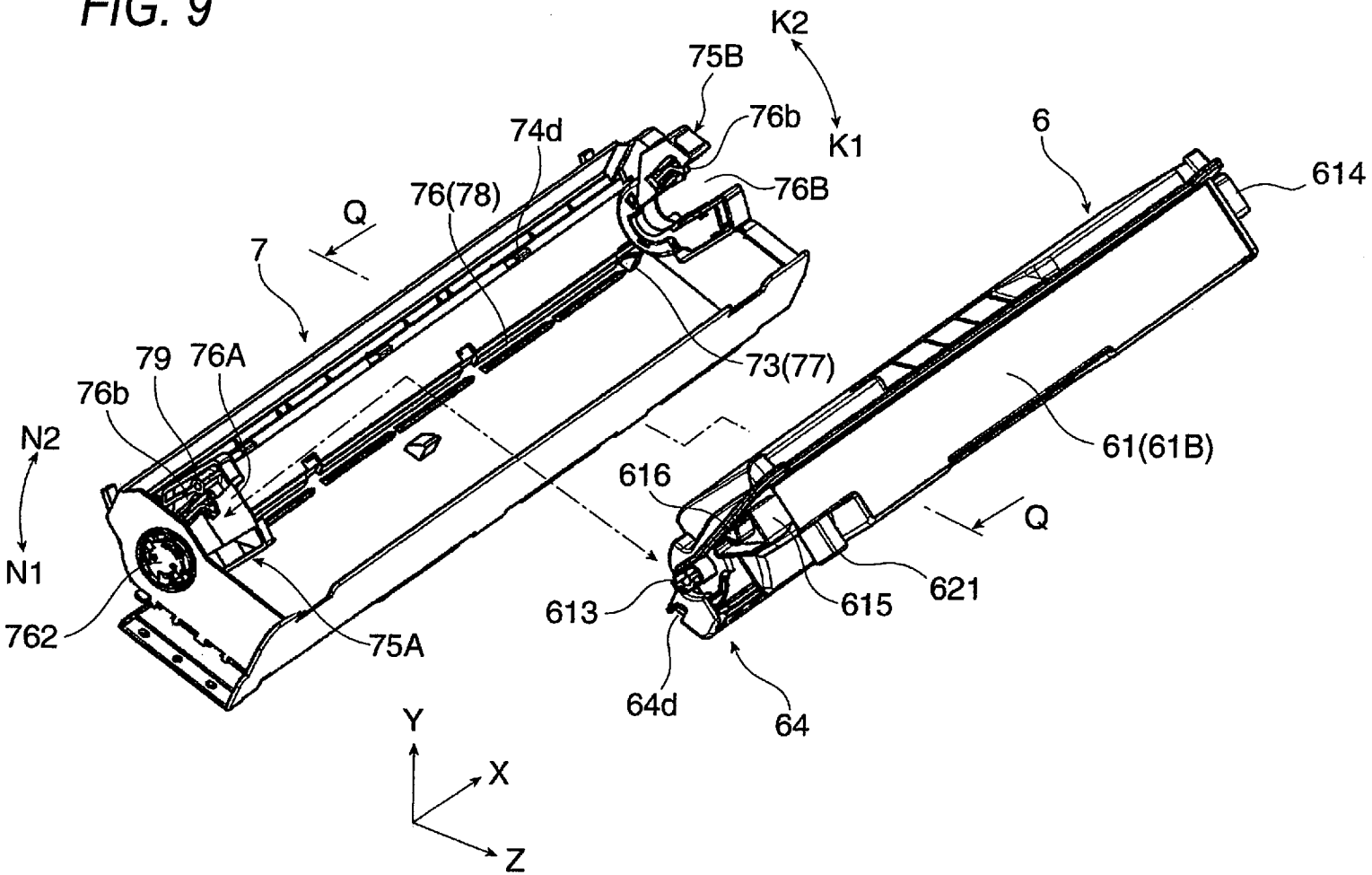
FIG. 9 is a perspective view showing a state of the developer recovery container and the mounting and holding frame thereof (a state in which the developer recovery container is removed)
Figure 10A:
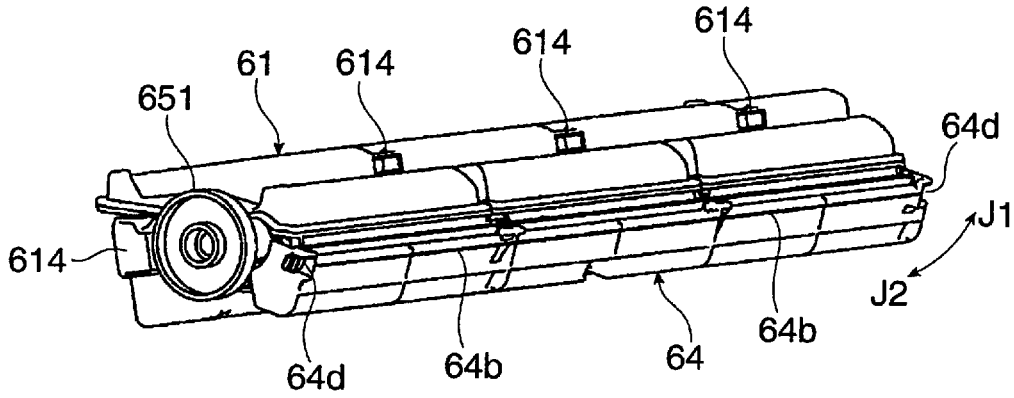
Figure 10B:
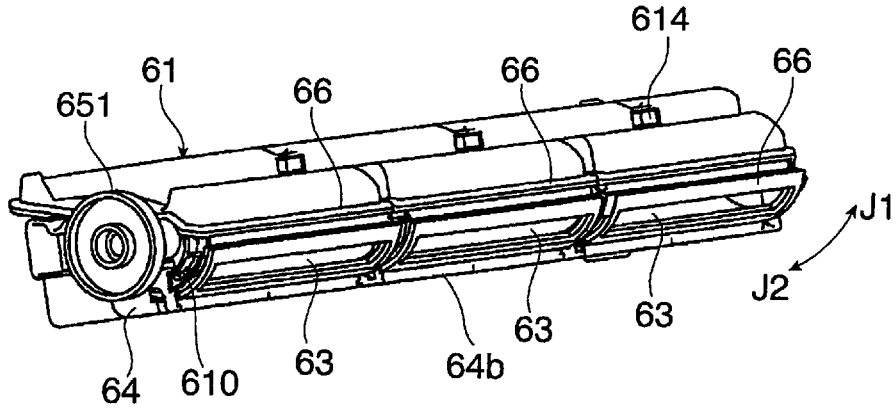
Figure 11:
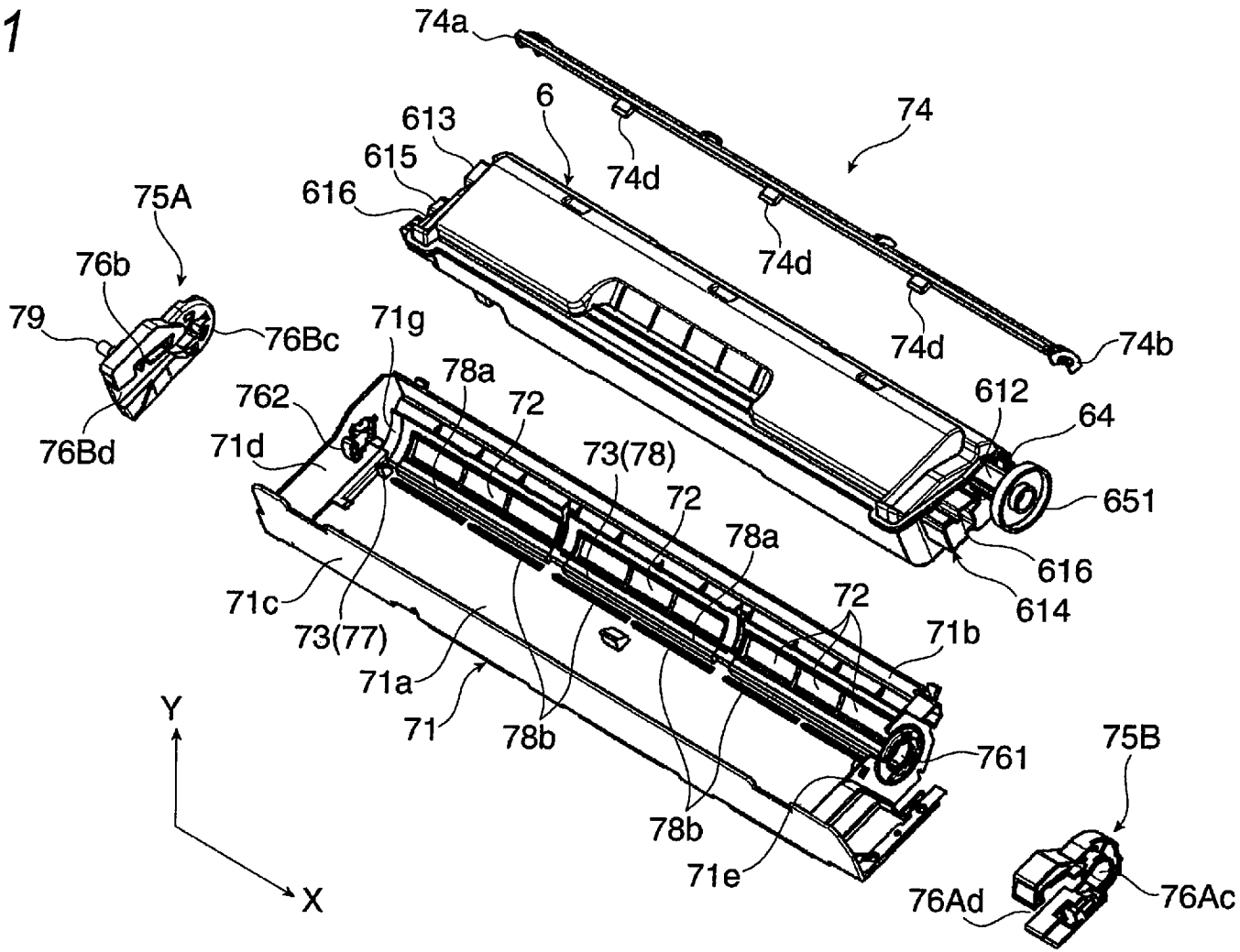
FIG. 11 is a perspective view showing the developer recovery container and the mounting and holding frame which is exploded.

FIGS. 6 to 11 are perspective views showing the developer recovery container 6 and the mounting and holding frame 7 thereof. FIG. 6 shows a state in which the developer recovery container 6 is displaced to a detachable position where the developer recovery container 6 detaches as a result of link with an opening operation of the opening/closing cover 16. FIG. 7 shows a state in which the state in FIG. 6 is seen from a different angle or viewpoint. FIG. 8 shows a state of the developer recovery container 6 and the mounting and holding frame 7 which results when the opening/closing cover 16 is closed. FIG. 9 shows a state in which the developer recovery container 6 is removed from the mounting and holding frame 7. FIGS. 10A and 10B show states in which a shutter of the developer recovery container 6 is opened and closed. FIG. 11 shows a state of the developer recovery container 6 and the mounting and holding frame 7 with the later exploded.

Figure 14:
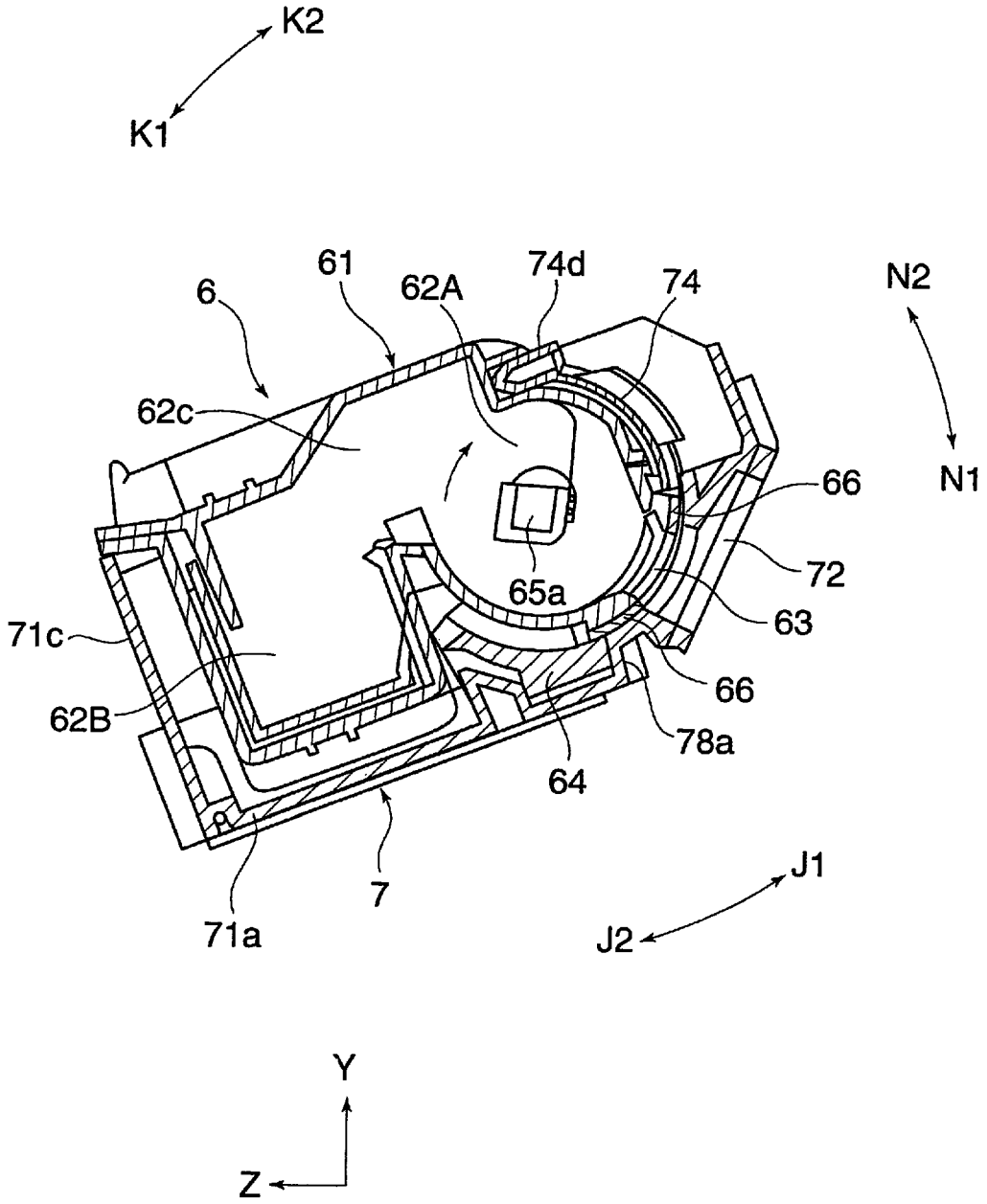
FIG. 14 shows explanatory sectional views of the developer recovery container and the mounting and holding frame which are taken along the line Q-Q in FIG. 8.
Figure 15:
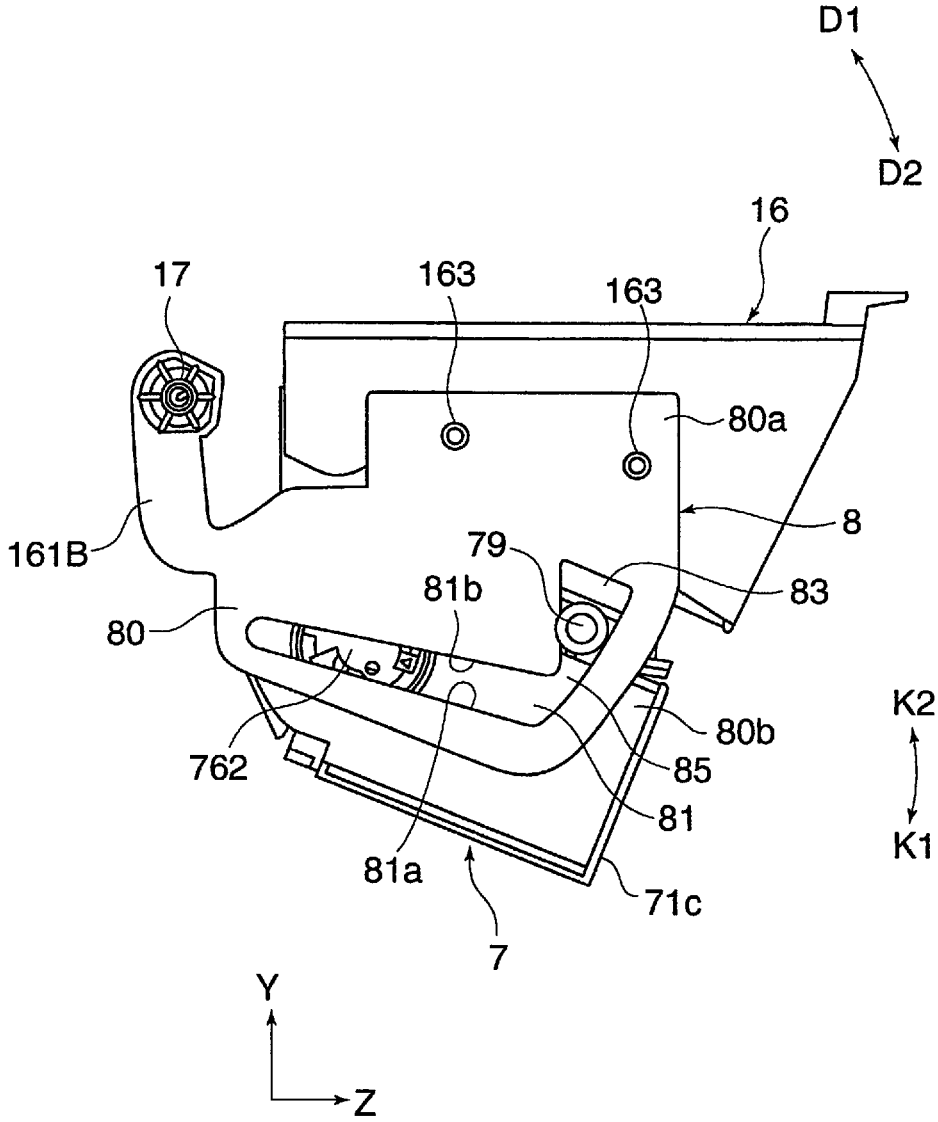
FIG. 15 is a side view showing a state of the opening/closing cover, the developer recovery container, the mounting and holding frame and a connection frame at the time of the full color mode.

The developer recovery container 6 is held so as to be displaced between a detachment operating position where the developer recovery container 6 is detached from the mounting and holding frame 7 (FIGS. 6, 13, 19B, 21B) and a mounting completed position where the developer recovery container 6 is completely mounted on the mounting and holding frame 7 (FIGS. 8, 14, 15, 16) with respect to the mounting and holding frame 7. In this image forming apparatus 1, as is shown in FIGS. 6, 15, the opening/closing cover 16 and part of the mounting and holding frame 7 are connected by a connecting frame 8. By adopting this configuration, the mounting and holding frame 7 which holds the developer recovery container 6 is displaced between the detachment operating position and the mounting completed position as a result of link with an opening or closing operation of the opening/closing cover 16 (FIGS. 19A to 22B). The connecting frame 8 and the operation of the mounting and holding frame 7 linked with the operation of the opening/closing cover 16 will be described in detail later.

As is shown in FIGS. 10A, 10B and 12 to 14, the developer recovery container 6 has a container main body 61 which includes an accommodating portion 62 which accommodates unnecessary substances (mainly toner) such as developers T that are removed by the belt cleaner 35 for recovery and opening portions 63 which allow the passage of unnecessary substances such as developers T, an opening/closing shutter 64 functioning as a lid which moves over the opening portions to open or close the opening portions 63 and a transport member 65 which transports developers T which are taken into the accommodating portion 62.

The accommodating portion 62 of the container main body 61 includes a primary accommodating portion 62A having a substantially circular section which first accommodates unnecessary substances such as toner that are transported from the belt cleaner 35, a secondary accommodating portion 62B having a substantially rectangular section which finally accommodates the unnecessary substances such as toner that are accommodated in the primary accommodating portion 62A and a connecting space portion 62C which connects the primary accommodating portion 62A and the secondary connecting portion 62B to each other in a position lying thereabove. The accommodating portion 62A has a long box-like shape which has a width that is almost the same as that of the cleaner main body 350. A transparent detection container 621 is provided at a longitudinal end portion of the secondary accommodating portion 62B so as to project outwards. As is shown in FIGS. 6, 9, the detection container 621 is a transparent container which is disposed so as to project outwards from a bottom side of the secondary accommodating portion 62B. Part of the unnecessary substances such as toner that is accommodated in the secondary accommodating portion 62B is accommodated in the detection container 621 to detect whether or not the secondary accommodating portion 62B is filled with unnecessary substances such as toners T by a fullness detector, not shown.

The opening portions 63 are formed in portions of a lateral side portion of the primary accommodating portion 62A of the container main body 61 which are located closer to a lower portion of the lateral side portion. The opening portions 63 may only have to be located in any position, provided that the opening portions 63 face connecting opening portions (72) of the mounting and holding frame 7 in a stage in which the developer recovery container 6 is rotated for complete mounting in the mounting and holding frame 7. The opening portions 63 in the first exemplary embodiment have substantially the same width as that of the discharge port 351 of the cleaner main body 350 of the bell cleaner 35 and are formed so as to divide a whole opening of the container main body 61 into three equally (FIG. 10B). Elastic seal materials 66 are affixed to respective peripheral portions of the opening portions 63 of the container main body 61 for closing gaps defined between circumferential portions of the opening portions 63 of the container main body 61 and the opening/closing shutter 64 (FIG. 10B).

Figure 12:
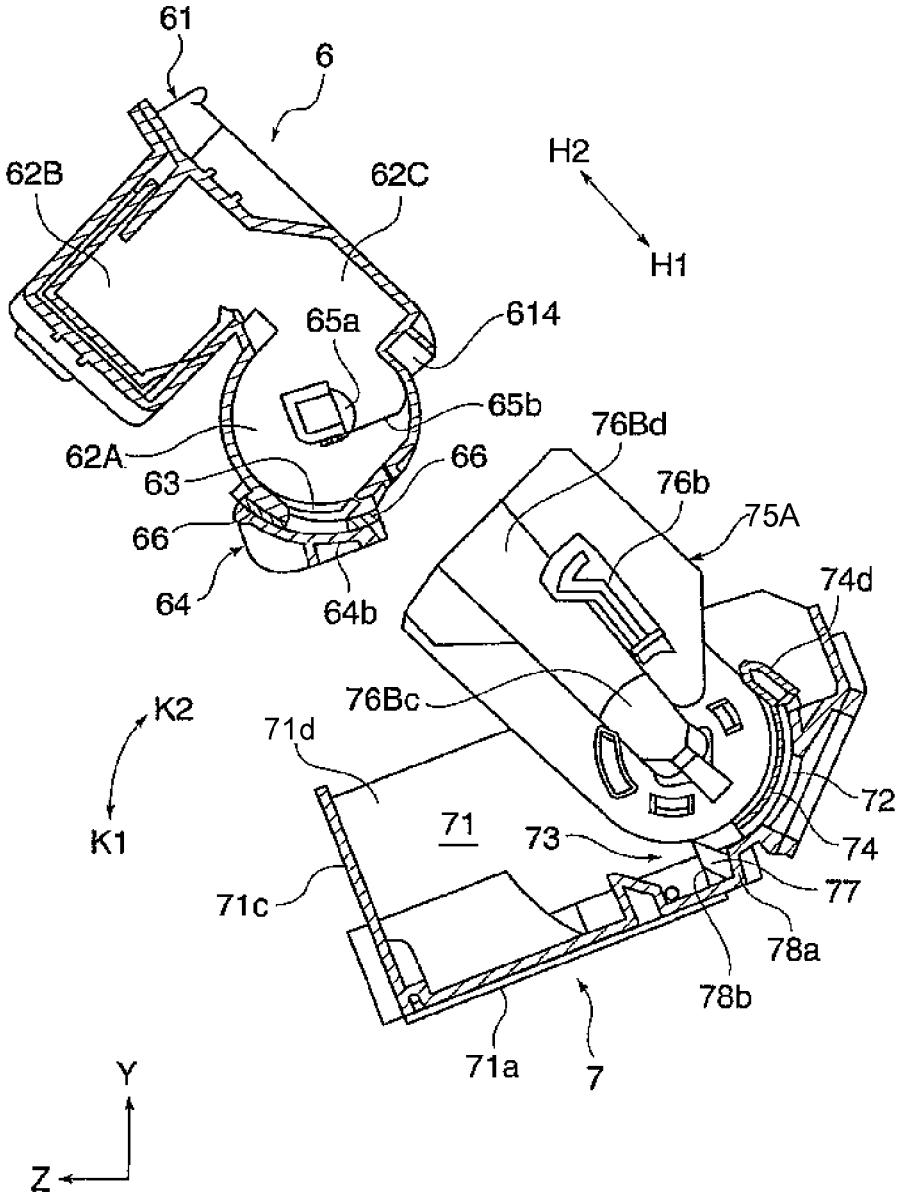
FIG. 12 shows explanatory sectional views of the developer recovery container and the mounting and holding frame which are taken along the line Q-Q in FIG. 9.

As is shown in FIGS. 10A, 10B and 12, the opening/closing shutter 64 has a narrow elongated plate-like shape which is shaped and sized so as to close the opening portions 63. In the first exemplary embodiment, the opening/closing shutter 64 is a substantially rectangular plate-like member which can cover all the three equally divided opening portions. An inner side of the opening/closing shutter 64 which faces the opening portions 63 has a curved shape (FIG. 12). As is shown in FIGS. 10A to 12, an insertion projecting portion 64*b* having a wedge-shaped section is formed at a longitudinal end portion of the opening/closing shutter 64 so as to extend in a straight line along its longitudinal direction. This insertion projecting portion 64*b* is fitted in a positioning groove portion (78) which fixes a mounting position of the opening/closing shutter 64 when the developer recovery container 6 is mounted in (a container holding portion 71 of) the mounting and holding frame 7. The positioning groove portion (78) will be described later.

As is shown in FIGS. 10A and 10B, the opening/closing shutter 64 is mounted so as to move with respect to the container main body 61 between a position where the opening/closing shutter 64 closes the opening portions 63 (FIG. 10A) and a position where the same shutter 64 opens the opening portions 63 (FIG. 10B). Because of this, the opening/closing shutter 64 includes end portion attachment portions 64*c* which are formed at longitudinal end portions thereof so as not only to project inwards but also to be curved. On the other hand, curved attachment guide grooves 610 are formed on lateral side portions at both longitudinal ends of a main body portion which constitutes the primary accommodating portion 62A of the container main body 61 for guiding the end portion attachment portions 64*c*. The opening/closing shutter 64 is attached to the container main body 61 by the curved end portion guide grooves 610 on the container main body 61 from the outside.

Figure 13:
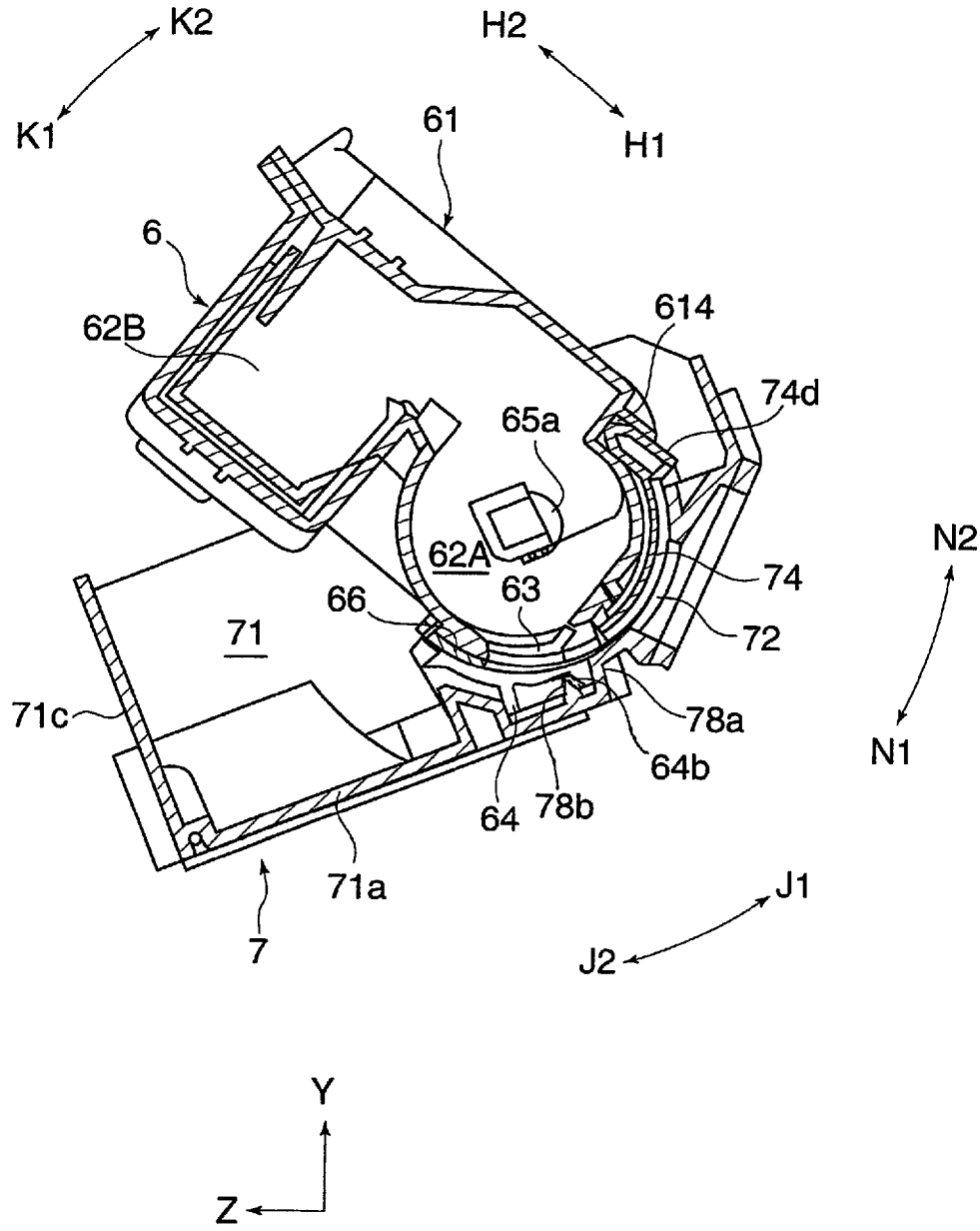
FIG. 13 shows explanatory sectional views of the developer recovery container and the mounting and holding frame which are taken along the line Q-Q in FIG. 7.

By adopting this configuration, the opening/closing shutter 64 can move in directions indicated by arrows J1, J2 by the end portion attachment portions 64*c* thereof being guided by the attachment guide grooves (FIGS. 10A and 10B). As a result of this, the opening/closing shutter 64 opens and closes the opening portions 63 by moving with respect to the container main body 61 (an external side portion of the primary accommodating portion 62A) between the position where the opening/closing shutter 64 closes the opening portions 63 and the position where the same shutter 64 opens the opening portions 63. Incidentally, in the developer recovery container 6, the actual movement of the opening/closing shutter 64 is implemented by rotating the container main body 61 (about a rotating shall 65*a* of the transport member 65 of the primary accommodating portion 62A as a fulcrum) so as to change the condition of the container main body 61 as will be described later (FIGS. 13<->14). In addition, the opening/closing shutter 64 is moved to the position where the shutter 64 closes the opening portions 63 in a dismounting state in which the developer recovery container 6 is not mounted in the mounting and holding frame 7 (FIGS. 10A, 12).

Further, as is shown in FIG. 10A, the opening/closing shutter 64 includes insertion holes 64*d* which are formed at both longitudinal end portions thereof (a direction which is at right angles to the moving directions J1, J2). As one of their functions, the insertion holes 64*d* are used when fixing the mounting position of the opening/closing shutter 64 by insertion projections (77) which are formed on a bottom side portion (71*a*) of the container holding portion (71) of the mounting and holding frame 7 being inserted into the insertion holes 64*d*.

The transport member 65 is such that a flexible film member 65*b* is attached to the shaft 65*a* which is attached rotatably to lateral side portions at longitudinal ends of the primary accommodating portion 62A of the container main body 61 (FIG. 12). This transport member 65 rotates in a direction indicated by an arrow (FIG. 14) by a rotating force from a drive unit, not shown, which is placed on the main body 10 side of the image forming apparatus being transmitted to a driven gear 651 which is fixed to an end portion of the shaft 65*a* which projects from one lateral side of the container main body 61. By adopting this configuration, the transport member 65 transports unnecessary substances such as toner which are taken into the primary accommodating portion 62A towards the secondary accommodating portion 62B through the connecting space portion 62*c* by virtue of a transporting force of the film member 65*b*.

As is shown in FIGS. 7 to 11, rotation support portions 612, 613 which are inserted into support grooves of a movable holder (75) of the container holding portion (71) for support and mounting fixing portions 614, 615 are provided at the lateral side portions at both the longitudinal ends of the container main body 61.

The rotation support portion 612 having an oval section which doubles as a bearing for the shaft 65*a* of the transport member 65 and the mounting fixing portion 614 which has a plane which is inclined so as to increase a space as it extends to the rear in a mounting insertion direction are provided on one of the lateral side portions which lies on the side where the driven gear 651 is disposed (FIG. 11). In addition, the rotation support portion 613 having an oval section which doubles as a bearing for the shaft 65*a* of the transport member 65 and the mounting fixing portion 615 which has a plane which is inclined so as to increase a space as it extends to the rear in the mounting insertion direction are provided on the other of the lateral side portions (FIG. 9). A recess portion 616 is formed on an upper side portion of each of the mounting fixing portions 614, 615 in which a dislocation prevention claw (76*b*), which will be described later, is caught.

On the other hand, as is shown in FIGS. 6, 9, 11, the mounting and holding frame 7 includes the container holding portion 71 in which the developer recovery container 6 is detachably mounted and is held rotatably, the connecting opening portions 72 which face the opening portions 63 of the developer recovery container 6 for connection with the developer recovery container 6 so as to allow the developers T to pass (to be taken) therethrough into the developer recovery container 6, a shutter fixing portion 73 which fixes the mounting position of the opening/closing shutter 64 of the developer recovery container 6 and a connection shutter 74 functioning as a movable lid which moves over the connecting opening portions 72 to open or close the same opening portions 72. As is shown in FIG. 4, this mounting and holding frame 7 is connected to the cleaner main body 350 of the belt cleaner 35 with the connecting opening portions 72 and the discharge port 351 caused to face each other for establishment a communication between the mounting and holding frame 7 and the cleaner main body 350.

The container holding portion 71 is a rectangular parallelepiped structure portion which is opened in an upper side and which has a housing space which can house a substantially lower portion of the container main body 61 of the developer recovery container 6 and the opening/closing shutter 64. Specifically speaking, the container holding portion 71 is made up of a rectangular bottom side portion 71*a*, an inclined side portion 71*b* which rises from a longitudinal edge portion of the bottom side portion 71*a* while being inclined at a required angle, a vertical side portion 71*c* which rises substantially vertically from the other longitudinal edge portion of the bottom side portion 71*a* and two lateral side portions 71*d*, 71*e* which rise substantially vertically at both longitudinal end portions. The connecting opening portions 72 are formed in the inclined side portion 71*b*.

In addition, as is shown in FIGS. 9, 11, the container holding portion 71 also includes movable holders 75A, 75B which actually hold the developer recovery container 6 to support them rotatably.

Both the movable holders 75A, 75B are members which have V-shaped support grooves 76A, 76B which are formed so as to receive the rotation support portions 612, 613 and the mounting fixing portions 614, 615 which are formed at both the end portions of the developer recovery container 6 for support thereof. The support grooves 76A, 76B are shaped so as not only to support the corresponding rotation support portions 612, 613 in such a way as to hold them at terminal end (deeper side) portions 76Ac, 76Bc of the support grooves 76A, 76B but also to support the mounting fixing portions 614, 615 in such a way as to hold them at near side portions 76Ad, 76Bd of the support grooves 76A, 76B. The elastic hook-like dislocation prevention claws 76*b* are formed on upper portions of the near side portions 76Ad, 76Bd of the support grooves 76A, 76B so as to be caught in the recess portions 616 on the upper side portions of the mounting fixing portions 614, 615 of the developer recovery container 6.

These movable holders 75A, 75B are, as is shown in FIGS. 6, 9, attached to inner sides of the lateral side portions 71*d*, 71*e* of the container holding portion 71 so as to swing in directions indicated by arrows K1, K2. Because of this, rotatable support devices 761, 762 which rotate with respect to the lateral side portions 71*d*, 71*e* are provided in positions on the inner sides of the lateral side portions 71*d*, 71*e* of the container holding portion 71 which lie closer to the inclined side portion 71*b*. In addition, the movable holders 75A, 75B are attached to the container holding portion 71 by circumferential portions of the deeper side portions 76Ac, 76Bc of the mounting grooves 76A, 76B being held on the rotatable support devices 761, 762 of the container holding portion 71. By doing so, the movable holders 75A, 75B are allowed to swing in the directions indicated by the arrows K1, K2 via the rotatable support devices 761, 762, so that the movable holders 75A, 75B can take either a state in which the movable holders 75A, 75B are housed in an interior of the container holding portion 71 (corresponding to the mounting completed position of the developer recovery container 6, FIGS. 8, 14) or a state in which one end portions of the movable holders 75A, 75B are exposed to the outside of the container holding portion 71 (corresponding to the detachable position of the developer recovery container 6, FIGS. 6, 13).

The connecting opening portions 72 face the opening portions 63 of the developer recovery container 6 so as to establish a communication between the container holding portion 71 and the container main body portion 61 and also face the discharge port 351 of the belt cleaner 35 so as to establish a communication between the container holding portion 71 and the belt cleaner 35 (FIG. 4). In the first exemplary embodiment, the connecting opening portions 72 have a substantially rectangular shape which has substantially the same width of the intermediate transfer belt 31 as with the opening portions 63 and the discharge port 351. Further, inner sides of the connecting opening portions 72 are curved so as to enable the rotation of the developer recovery container 6 (the rotating motions in the directions indicated by the arrows K1, K2 via the movable holders 75A, 75B).

As is shown in FIGS. 9, 11, 12, the shutter fixing portion is formed at a portion on the bottom side portion 71*a* of the container holding portion 71 which lies closer to the inclined side portion 71*b*. Namely, the shutter fixing portion 73 includes the insertion projections 77 which fix the mounting position of the opening/closing shutter 64 of the developer recovery container 6 and the positioning groove portions 78 which position the mounting position of the opening/closing shutter 64.

The insertion projection 77 is formed at the longitudinal end portion of the bottom side portion 71*a* so as to project towards (the insertion hole 64*d* of) the opening/closing shutter 64 of the developer recovery container 6 which is mounted in the shutter fixing portion 73. By the insertion projection 77 being inserted into the insertion hole 64*d* of the opening/closing shutter 64, the mounting position of the opening/closing shutter 64 is fixed by the insertion projection 77. Namely, the opening/closing shutter 64 is held in such a state that the same shutter is fixed by the insertion projections 77 at both the longitudinal end portions thereof.

The positioning groove portion 78 is formed as a space which is held between a step portion 78*a* between the bottom side portion 71*a* of the container holding portion 71 and the inclined side portion 71*b* which is positioned below the connecting opening portion 72 and a projecting portion 78*b* having a wedge-shaped section which is formed on the bottom side portion 71*a* so as to project therefrom while being spaced apart from the step portion 78*a*. By the insertion projecting portions 64*b* of the opening/closing shutter 64 being inserted into the positioning groove portions 78, the mounting position of the opening/closing shutter 64 is determined. Namely, the opening/closing shutter 64 is mounted in the right position with respect to the shutter fixing portion 73 of the mounting and holding frame 7.

As is shown in FIGS. 9, 11, 12, the connection shutter 74 is a narrow elongated plate-like shape which is shaped and sized so as to close the connecting opening portions 72. In the first exemplary embodiment, the connection shutter 74 is a substantially rectangular plate-like member having a curved section.

As is shown in FIGS. 12 to 15, the connection shutter 74 is attached so as to move with respect to (the inclined side portion 71*b* of) the mounting and holding frame 7 between a position where the connection shutter 74 closes the connecting opening portions 72 (FIGS. 9, 12) and a position where the connection shutter 74 opens the connecting opening portions 72. Because of this, connecting portions 74*a*, 74*b* are formed at longitudinal end portions of the connection shutter 74 (FIG. 11). These connecting portions 74*a*, 74*b* face the rotation support point side portions of the corresponding movable holders 75A, 75B of the container holding portion 71 and are then connected thereto in such a state that the connecting portions 74*a*, 74*b* are caught in the rotation support point side portions, respectively (FIG. 12).

Further, a plurality of projecting portions 74*d* are formed at an upper end portion of the connection shutter 74 so as to project towards the developer recovery container 6 side (FIGS. 9, 11, 12). These projecting portions 74*d* are inserted in to a plurality of insertion holes 614 (FIGS. 10A, 10B, 12) which are formed at a corner portion of the external side portion of the container main body 61 of the developer recovery container 6 which lies upper than the opening/closing shutter 64 so as to connect the connection shutter 74 to the developer recovery container 6 (FIG. 13). In addition to this, the connection shutter 74 is placed so that curved external surfaces of the connecting portions 74*a*, 74*b* are brought into contact with curved inclined portions 71*g* which are formed at portions on an inner surface of the inclined side portion 71*b* of the container holding portion 71 which lie outwards of the connecting opening portions 72 (FIG. 11).

The connection shutter 74 is placed inside the inclined side portion 71*b* of the container holding portion 71 so as to close the connecting opening portions 72 and is attached so that the connecting portions 74*a*, 74*b* which are provided at both the end portions are brought into contact with part of the movable holders 75A, 75B.

By doing so, the connection shutter 74 can move in directions indicated by arrows N1, N2 by the external surfaces of the connecting portions 74*a*, 74*b* being guided by the curved inclined portions 71*g* (FIGS. 9, 13). As a result of this, the connection shutter 74 opens or closes the connecting opening portions by moving relatively to the mounting and holding frame 7 (the inclined side portion 71*b* of the container holding portion 71) between the position where it closes the connecting opening portions 72 and the position where it opens the connecting opening portions 72. In reality, as will be described later, the movement of the connection shutter 74 is implemented by rotating the container main body 61 of the developer recovery container 6 (in the directions indicated by the arrows K1, K2 via the movable holders 75A, 75B) so as change the state of the container main body 61 (FIGS. 12 to 14).

Next, the operations, of the developer recovery container 6 will be described which are performed when the same container is dismounted and mounted.

Firstly, the developer recovery container 6 is mounted in the mounting and holding frame 7. In mounting the developer recovery container 6 in this way, as is shown in FIGS. 6, 9, 13, the developer recovery container 6 is moved so as to be attached to the movable holders 75A, 75B of the container holding portion 71 of the mounting and holding frame 7 with the opening/closing shutter 64 leading the attachment.

By doing so, as is shown in FIGS. 6, 15, the developer recovery container 6 is supported by the rotation support point portions 612, 613 and the mounting fixing portions 614, 615 which are provided on the lateral side portions at both the end portions of the container main body 61 being fitted in the support grooves 76A, 76B of the movable holders 75A, 75B, respectively. In addition, the developer recovery container 6 is held by the movable holders 75A, 75B in an ensured fashion by the elastic catch or dislocation prevention claws 76*b* on the movable holders 75A, 75B being fitted in the recess portions 616 of the mounting fixing portions 614, 615 to thereby be caught therein.

In mounting the developer recovery container 6 in the mounting and holding frame 7, the opening/closing shutter 64 of the developer recovery container 6 has moved to the position where it closes the opening portions 63. In addition, the movable holders 75A, 75B have been rotated in the direction indicated by the arrow K2 so that their free end portions are allowed to project from the interior to the exterior of the container holding portion 71 (the detachment operating position) (in reality, the movable holders 75A, 75B are displaced to the detachment operating position as a result of link with opening the opening/closing cover 16), and the developer recovery container 6 is moved towards the support grooves 76A, 76B in that state (along a direction indicated by an arrow H1. In FIG. 12 and the like, the reason that the mounting and holding frame 7 is shown as being inclined obliquely is that the mounting and holding frame is attached so as to extend along the intermediate transfer unit 30 which is disposed in the inclined state (FIG. 2). In addition, also in the mounting and holding frame 7, the connection shutter 74 has moved to the position where it closes the connecting opening portions 72 as a result of the rotation of the movable holders 75A, 75B in the direction indicated by the arrow K2.

When the developer recovery container 6 is mounted in the way described above, as is shown in FIG. 13, the opening/closing shutter 64 of the developer recovery container 6 is fixed at the shutter fixing portion 73 of the container holding portion 71. Namely, the mounting position of the opening/closing shutter 64 is fixed by the insertion projections 77 being inserted to be fitted in the insertion holes 64*b* at both the longitudinal end portions thereof, whereby the opening/closing shutter 64 is in such a state that the shutter 64 is prevented from moving relatively to the container main body 61 in the moving directions J1, J2 in which the opening/closing shutter 64 closes and opens the opening portions 63. In addition, the mounting position of the opening/closing shutter 64 is determined formally by the insertion projection 64*b* which is formed to extend along its longitudinal direction being inserted in the positioning groove 78. Further, as is shown in FIG. 13, the connection shutter 74 of the mounting and holding frame 7 is connected to the container main body 61 so as to be integrated therewith by the projecting portions 74*d* being inserted into the insertion holes 614 in the container main body 61 of the developer recovery container 6.

Following this, in the developer recovery container 6, as is shown in FIGS. 8, 14, the container main body 61 is caused to rotate in the direction indicated by the arrow K1, so that the container main body 61 (actually, the side thereof where the secondary accommodating portion 62B exits) is housed in the space within the container holding portion 71 (the mounting completed position).

When the developer recovery container 6 is caused to rotate in the direction indicated by the arrow K1, the container main body 61 moves (swings) in the direction indicated by the arrow K1 about the shaft 65*a* of the transport member 65 in the primary accommodating portion 62A as a fulcrum in such a state that the container main body 61 is held by the movable holders 75A, 75B. The opening portions 63 in the container main body 61 move towards the connecting opening portions 72 in the mounting and holding frame 7 by the rotation of the container main body 61 and finally come to face the connecting opening portions 72 to establish a communication between the mounting and holding frame 7 and the container main body 61. At the same time as this occurs, the connection shutter 74 moves together with the container main body 61 (including the movable holder 75) and finally comes to open the connecting opening portions 72. In this event, the connection shutter 74 moves relatively to the container holding portion 71 in the direction indicated by the arrow N2.

As this occurs, since the opening/closing shutter 64 of the developer recovery container 6 is fixed to the shutter fixing portion 73, the opening/closing shutter 64 is kept stationary without rotating together with the container main body 61. Because of this, the opening portions 63 are moved away from the opening/closing shutter 64 which is kept stationary as a result of the rotation of the container main body 61, whereby the opening/closing shutter 64 keeps the opening portions 63 open. In this event, the opening/closing shutter 64 moves relatively to the container main body 61 in the direction indicated by the arrow J2 when viewed from the container main body 61 side. In addition, specifically speaking, the opening/closing shutter 64 moves while the end portion attachment portions 64*c* which are provided at the longitudinal end portions thereof are being guided by the guide grooves 610 on the container main body 61.

As a result of this, as is shown in FIG. 14, the opening portions 63 of the developer recovery container 6 move to the position where the connection shutter 74 opens so as to face the connecting opening portions 72 of the mounting and holding frame 7 which are kept opened for establishment of a communication between the developer recovery container 6 and the mounting and holding frame 7. By doing so, the developer recovery container 6 is mounted completely in the mounting and holding frame 7. Incidentally, the next occasion when the developer recovery container 6 is mounted in the mounting and holding frame 7 will come as a result of link with a closing operation of the opening/closing cover 16. In addition, the developer recovery container 6 gets ready for use when it is mounted in the mounting completed position.

When in use, in the developer recovery container 6, as is shown in FIG. 4, unnecessary substances such as developers which are removed by the belt cleaner 35 are sent into the primary accommodating portion 62A of the container main body 61 from the opening portion 63 through the connecting opening portions 72 (by being transported by the secondary transport unit 37). The unnecessary substances such as developers which are sent into the primary accommodating portion 62A are then sent into the secondary accommodating portion 62B by virtue of the transporting force of the transport member 65 which rotates in the direction indicated by the arrow.

Then, the unnecessary substances such as developers which are accommodated in the secondary accommodating portion 62B are accumulated and increased. Then, when the secondary accommodating portion 62B is filled with the unnecessary substances such as developers, the fullness of the secondary accommodating portion 62B is detected by the detector, not shown. When the secondary accommodating portion 62B is filled to its capacity, the developer recovery container 6 is removed from the mounting and holding frame 7 for replacement with a new developer recovery container 6 or the unnecessary substances such as developers that are accommodated in the removed developer recovery container 6 is disposed of so that the same container is mounted back in the mounting and holding frame 7 for reuse.

Next, operations will be described which are performed when the developer recovery container 6 is removed from the mounting and holding frame 7.

In removing the developer recovery container 6 from the mounting and holding frame 7, in the developer recovery container 6, first of all, the container main body 61 thereof is caused to rotate in the direction indicated by the arrow K2. Finally, the container main body 61 (in reality, the side thereof where the secondary accommodating portion 62B is provided) is caused to project from the interior to the exterior of the space within the container holding portion 71. Namely, (the movable holder 75 of) the mounting and holding frame 7 which holds the developer recovery container 6 is displaced to the detachment operating position.

When the developer recovery container 6 is caused to rotate in the direction indicated by the arrow K2, the container main body 61 moves (swings) in the direction indicated by the arrow K2 about the shaft 65*a* of the transport member 65 within the primary accommodating portion 62A as the fulcrum in such a state that the container main body 61 is held by the movable holders 75A, 75B. The opening portions 63 of the container main body 61 are moved away from the connecting opening portions 72 of the mounting and holding frame 7 by the rotation of the container main body 61 and finally come to the position where they do not face the connecting opening portions 72, whereby the communication between the container main body 61 and the mounting and holding frame 7 is interrupted. At the same time as this occurs, the connection shutter 74 moves together with the container main body 61 and finally come to close the connecting opening portions 72. In this event, the connection shutter 74 moves relatively to the container holding portion 71 in the direction indicated by the arrow N1.

In this event, due to the opening/closing shutter 64 of the developer recovery container 6 being fixed to the shutter fixing portion 73, the opening/closing shutter 64 remains stationary without rotating together with the container main body 61. By doing so, the opening portions 63 move to approach the stationary opening/closing shutter 64 by the rotation of the container main body 61, whereby the opening/closing shutter 64 come to close the opening portions 63. In this event, the opening/closing shutter 64 moves relatively to the container main body 61 in the direction indicated by the arrow 11 when viewed from the container main body 61 side.

Following this, in the developer recovery container 6, as is shown in FIGS. 6 and 13, the container main body 61 is caused to project from the interior to the exterior of the space within the container holding portion 71. Thereafter, the container main body 61 is moved so as to be pulled out in the direction H2 in which the container main body 61 is removed from the container holding portion 71 of the mounting and holding frame 7. By doing so, as is shown in FIGS. 9, 12, the rotation support point portions 612, 613 and the mounting fixing portions 614, 615 which are provided on the lateral side portions at both the end portions of the container main body 61 are pulled out of the support grooves 76A, 76B of the movable holders 75A, 75B, respectively.

As a result of this, the developer recovery container 6 is removed from the mounting and holding frame 7. In the developer recovery container 6 which is being removed from the mounting and holding frame 7, the opening portions 63 are closed by the opening/closing shutter 64 (FIG. 12). In addition, in the mounting and holding frame 7 from which the developer recovery container 6 has been removed, the connecting openings 72 are closed by the connection shutter 74 (FIGS. 9, 12).

Next, the connection frame 8 and the linked configuration will be described.

Figure 16:
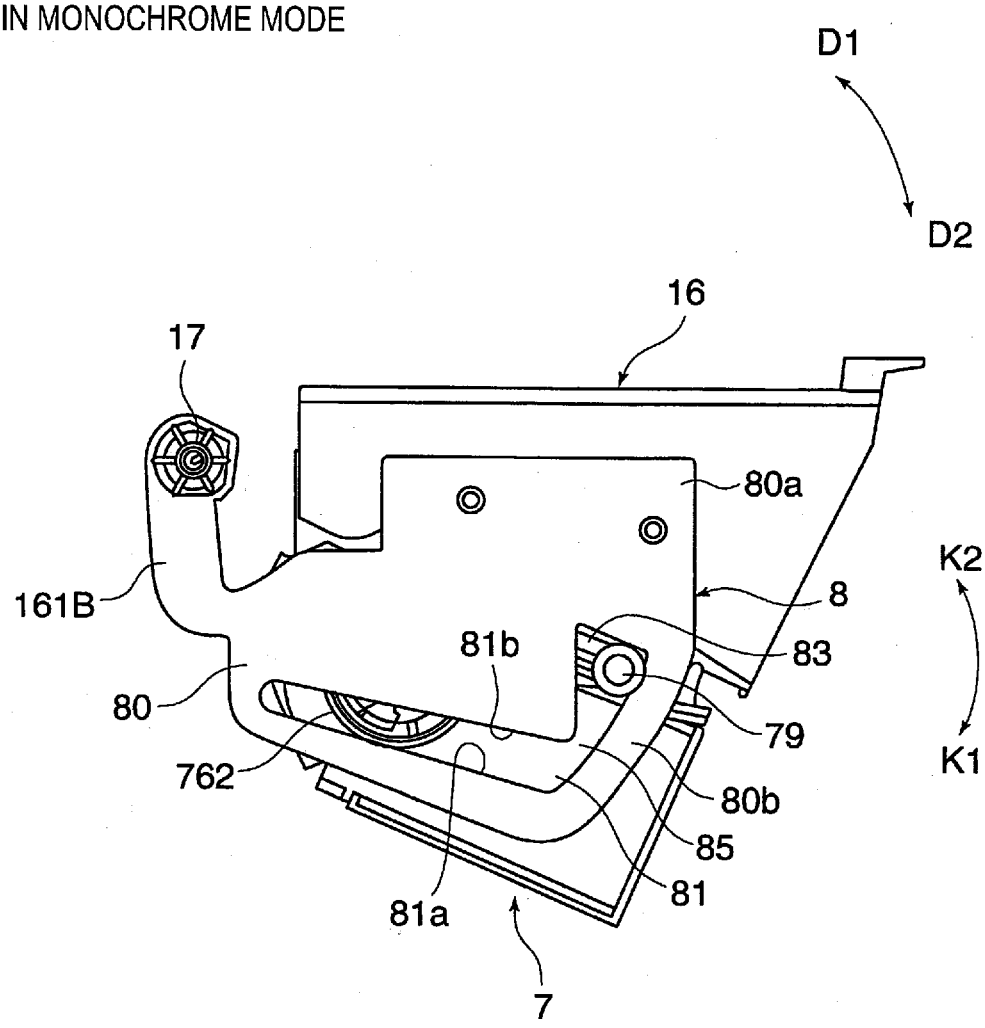
FIG. 16 is a side view showing a state of the opening/closing cover, the developer recovery container, the mounting and holding frame and a connection frame at the time of the monochrome mode.

As is shown in FIGS. 15, 16, the connection frame 8 connects between the opening/closing cover 16 and part (the movable holder 75) of the mounting and holding frame 7. By so providing the connection frame 8, when the opening/closing cover 16 is opened or closed, (the movable holder 75 of) the mounting and holding frame 7 is displaced to the detachment operating position or to the mounting completed position as a result of link with the opening or closing operation of the opening/closing cover 16.

In the first exemplary embodiment, the connection frame 8 is made up of a plate-like member 80. One end portion 80*a* of the plate-like member 80 is attached to the opening/closing cover 16 by a fixing device such as screws 163. A guide groove 81 is formed at the other end portion 80*b* so as to penetrate therethrough. As is shown in FIGS. 9, 11, a round rod-like projecting pin 79 is provided at part (a free end portion side) of the movable holder 75 so as to project outwards therefrom, and the projecting pin 79 is inserted through a space within the guide groove 81. Incidentally, the connection frame 8 illustrated in this exemplary embodiment is configured as being integrated with an arm member 161B which is provided at one side of the opening/closing cover 16. However, the connection frame 8 may be configured as a connecting portion which constitutes a single independent constituent component which is separated from the arm member 161.

Figure 17:
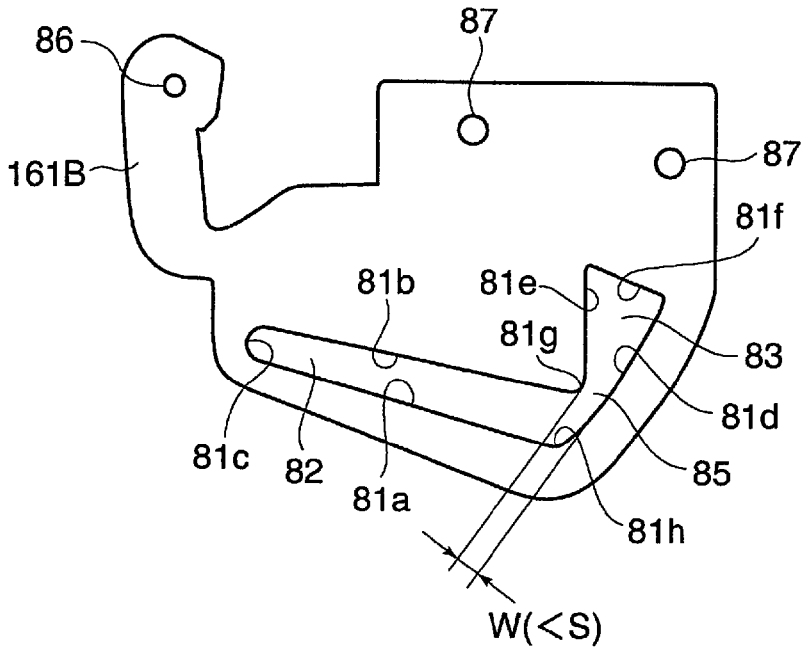
FIG. 17 is a front view showing a configuration of the connection frame.

As is shown in FIG. 17 and the like, the guide groove 81 is shaped to have at least a primary guide portion 81*a* which is a portion shaped to guide the projecting pin 79 so that a force generated when the opening/closing cover 16, which swings about a shaft 17, is operated to be opened (when the opening/closing cover 16 swings in a direction indicated by an arrow D1) is applied to the movable holder 75A and a secondary guide portion 81*b* which is a portion shaped to guide the projecting pin 79 so that a force generated when the opening/closing cover 16 is operated to be closed is applied to the movable holder 75A. In the first exemplary embodiment, the primary guide portion 81*a* and the secondary guide portion 81*b* are formed as planes (or end face portions of the plate member) which face each other in a substantially parallel fashion and extend in a straight line.

In FIG. 17 and the like, reference numeral 81*a* denotes a groove constituent portion which is a portion connecting the primary guide portion 81*a* and the secondary guide portion 81*b* and which forms a U-shaped space 82. This space 82 is formed so as to be made use of as a space (a primary waiting space portion) for the projecting pin 79 to reside and wait when the opening/closing cover 16 is opened completely. In addition, reference numerals 81*d*, 81*e*, 81*f* denote groove constituent portions which form a space (a secondary waiting space portion) for the projecting pin 79 to reside and wait when the opening/closing cover 16 is closed completely. Reference numeral 81*h* denotes a boundary portion between the groove constituent portion 81*d* and the primary guide portion 81*a*. Further, reference numeral 86 denotes a shaft hole through which the shaft 17 passes which constitutes a fulcrum of the opening/closing cover 16. Reference numeral 87 denotes holes through which the screws 163 pass by which the connection frame 8 is attached to the opening/closing cover 16. Here, the primary guide portion 81*a* also functions to guide the projecting pin 79 so that the projecting pin 79 moves out of the secondary waiting space portion 83. Because of this, the primary guide portion 81*a* can also include as a constituent portion the groove constituent portion 81*d* which constitutes the secondary waiting space portion 83 and which passes through a narrow portion 85.

In addition, the guide groove 81 is formed as a groove in which the primary guide portion 81*a*, the secondary guide portion 81*b*, the primary waiting space portion 82 and the secondary waiting space portion 83 are connected into a single groove. However, the configuration of the groove has the portion (the narrow portion 85 which will be described later) which is configured in consideration of the following situations.

Namely, in this image forming apparatus 1, as has been described before, the intermediate transfer unit 30 is displaced via the movable frame 38 by a retracting mechanism depending upon the selection of the full color mode or the monochrome mode (FIGS. 5A and 5B). Because of this, the mounting and holding frame 7 (including the movable holder 75) which is supported integrally on the movable frame 38 of the intermediate transfer unit 30 is also displaced in the same fashion. As a result of this, there occur situations in which its mounting completed position is located in different positions. FIG. 15 shows a state in which the mounting and holding frame 7 resides in its mounting completed position (a primary mounting completed position) when the full color mode is selected. FIG. 16 shows a state in which the mounting and holding frame 7 resides in its mounting completed position (a secondary mounting completed position) when the monochrome mode is selected.

Figure 18:
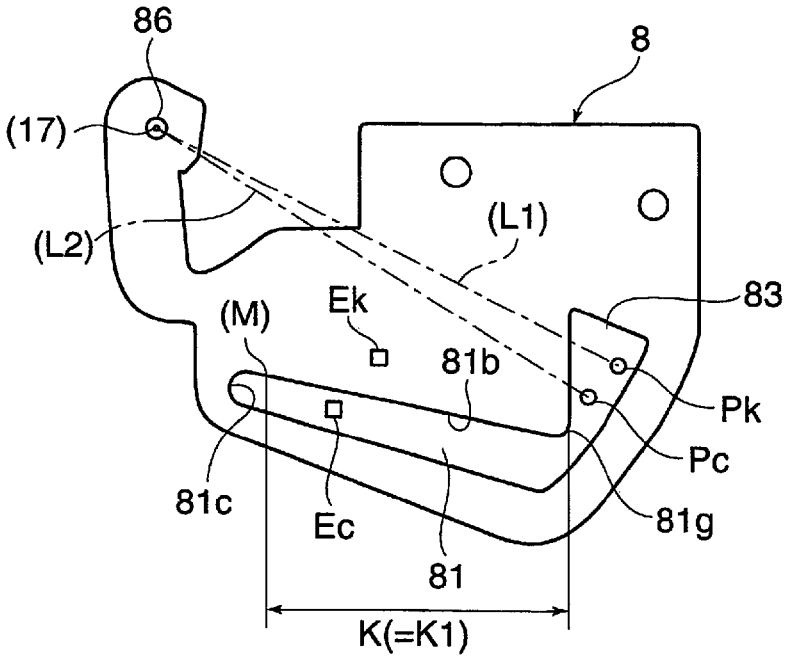
FIG. 18 is a front view showing a connection frame having a different configuration.

Due to the mounting completed position of the mounting and holding frame 7 differing between the full color mode and the monochrome mode, as is shown in FIGS. 15 to 18, the position (indicated by a white circle) P of the projecting pin 79 at the movable holder 75A of the mounting and holding frame 7 and the position (indicated by a white square) E of the rotation support point at the movable holders 75A, 75B are changed to different positions relative to the connection frame 8 whose position is fixed with the opening/closing cover 16 closed. In FIG. 18, reference characters Pc, Ec denote positions when the full color is selected, and reference characters Pm, Em denote positions when the monochrome mode is selected. Namely, both the rotation support point E about which the movable holder 75A of the mounting and holding frame 7 which is an object to be linked with the opening or closing operation of the movable cover 16 swings and the position P of the projecting pin 79 change.

Because of this, the opening/closing cover 16 and the movable holder 75A of the mounting and holding frame 7 cannot be connected by a known link mechanism, for example.

in addition, as is shown in FIG. 18, a spaced-away distance L1 between a position Pk of the projecting pin 79 in the primary mounting completed position when the monochrome mode is selected and the shaft 17 which constitutes the fulcrum or support point of the opening/closing cover 16 becomes relatively longer than a spaced-away distance L2 (>L1) between a position Pc of the projecting pin 79 in the secondary mounting completed position when the full color mode is selected and the shaft 17. As a result, a required guiding distance of the secondary guide portion 81*b* of the guide groove 81 which is used when the opening/closing cover 16 is closed (K: a length from a required position M of a turning portion 81*c* to a boundary portion 81*g* with the secondary waiting space portion 83) differs. Namely, a required guiding distance (K1) when the mounting and holding frame 7 is located in the primary mounting completed position becomes longer than a required guiding distance (K2) when the mounting and holding frame 7 is located in the secondary mounting completed position. In this case, in the event that the guiding distance K of the secondary guide portion 81*b* of the guide groove 18 is set to the shorter guiding distance (K1); the force generated when the opening/closing cover 16 is closed cannot be applied to the projecting pin 79 sufficiently throughout the operation in the secondary mounting completed position which requires the longer guiding distance (K2) (the projecting pin 79 falls in the secondary waiting space portion 83 halfway). On the contrary, in the event that the guiding distance K of the secondary guide portion 81*b* is set to the longer guiding distance (K2), the force generated when the opening/closing cover 16 is closed is applied to the projecting pin 79 more than required (excessively) in the primary mounting completed position which requires the shorter guiding distance (K1).

Then, in the first exemplary embodiment, as is shown in FIG. 17 and the like, the guiding distance K of the secondary guide portion 81*b* of the guide groove 81 is set to the relatively shorter guiding distance K1 which is required when the mounting and holding frame 7 is located in the primary mounting completed position (FIG. 18). Then, the narrow portion 85 is formed at the boundary portion 81*g* between the secondary guide portion 81*b* and the secondary waiting space portion 83 (a final point of the secondary guide portion 81*b*). In the narrow portion 85, the groove width W of the guide groove 81 is narrower than an outer dimension (in this exemplary embodiment, a diameter) S of a portion of the projecting pin 79 which contacts the guide groove 81. The narrow portion 85 is formed by shaping the open guide portion 81*d* which constitutes the secondary waiting space portion 83 so as to approach the boundary portion 81*g*. The groove width W of the narrow portion 85 is set to take a narrower value than the outer dimension S of the projecting pin 79 in consideration of a load generated when the opening/closing cover 16 is closed and a force required for an ensured displace of the movable holder 75A of the mounting and holding frame 7 to the mounting completed position.

In addition, in the first exemplary embodiment, as is shown in FIGS. 15, 16, 17 and the like, the size and configuration of the space within the secondary waiting space portion 83 are set so that the projecting pin 79 does not contact any (groove constituent portions 81*d*, 81*e*, 81*f*) of the secondary waiting space portion 83 even in the event that the movable holder 75A of the mounting and holding frame 7 is located either in the primary mounting completed position or the secondary mounting completed position. However, in case the projecting pin 79 continues to be in the waiting state, the projecting pin 79 may be configures so as to be brought into contact with part of the secondary waiting space portion 83.

Next, operations of the movable cover 16 and the movable holder 75A of the mounting and holding frame 7 which are connected together by the connection frame 8 will be described.

Figure 19A:
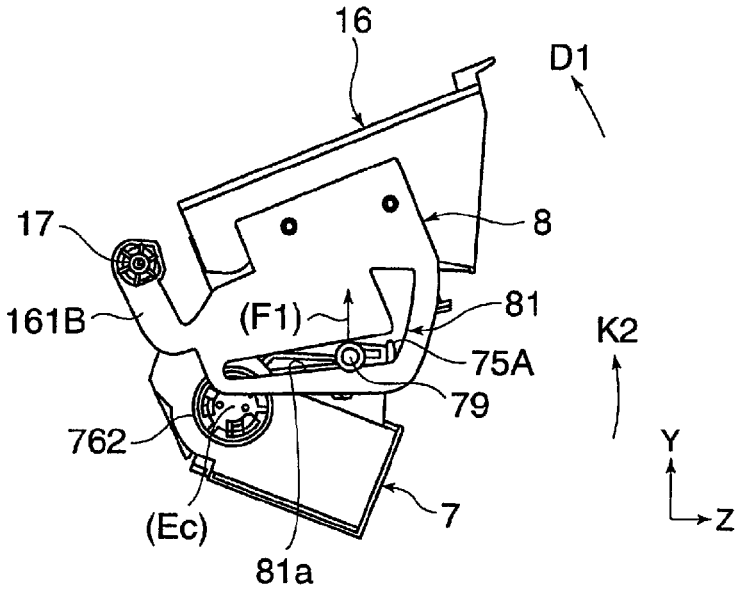
Figure 19B:
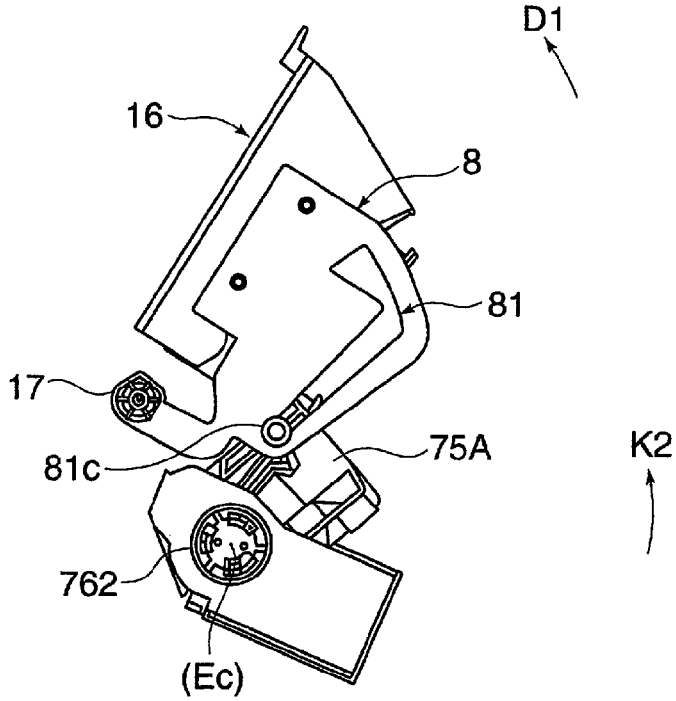

First of all, FIGS. 19A and 19B show a state in which the movable holder 75A of the mounting and holding frame 7 is displaced from the primary mounting completed position to the detachment operating position in association with the opening operation of the opening/closing cover 16 in the full color mode. FIG. 19A shows a state occurring in a halfway stage of the displacement, and FIG. 19B shows a state occurring when the opening/closing cover 16 is opened completely and the movable holder 75A is displaced to the detachment operating position.

As this occurs, when the opening/closing cover 16 is caused to swing about the shaft 17 as the fulcrum in a direction indicated by an arrow D1 to be opened, as is shown in FIG. 19A, the projecting pin 79 moves out of the secondary waiting space portion 83 of the guide groove 81 and is then guided into the primary guide portion 81*a*. Then, the projecting pin 79 receives a force (F1) generated by the opening operation of the opening/closing cover 16 and directed upwards while the projecting pin 79 is brought into contact with the primary guide portion 81*a* and moves by a required guiding distance. By doing so, the movable holder 75A swings about a rotation support device 762 which constitutes a rotation support point (Ec) thereof in a direction indicated by an arrow K2.

Then, when the opening/closing cover 16 swings to a restricting position where the opening/closing cover 16 is opened completely, as is shown in FIG. 19B, the projecting pin 79 moves as far as the primary waiting space portion 82 of the guide groove 81 and stops thereat. In this case, the projecting pin 79 comes into contact with the turning portion 81*c*. As a result of this, the movable holder 75A is displaced to the detachment operating position (FIGS. 6, 12). Then, a detaching operation of the developer recovery container 6 can be performed on the movable holder 75A which is now in the detachment operating position (FIG. 12). In FIG. 19B and the like, a state is shown in which the developer recovery container 6 is removed.

Figure 20A:
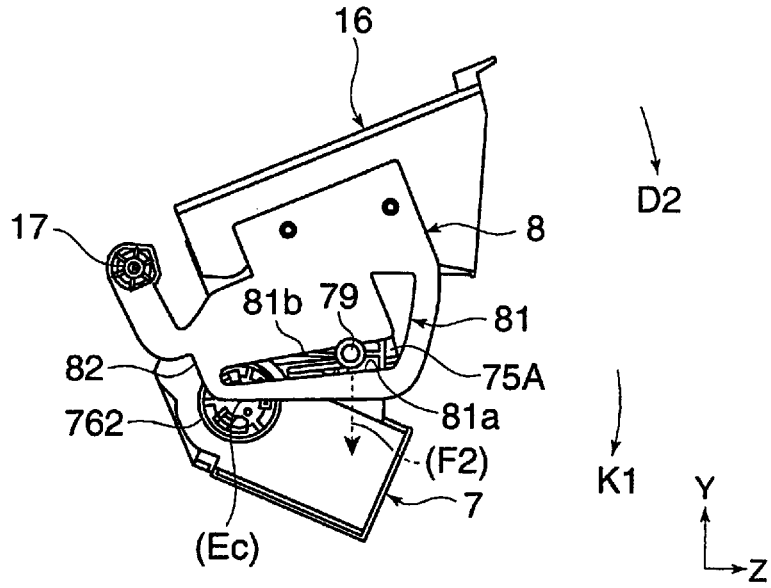
Figure 20B:
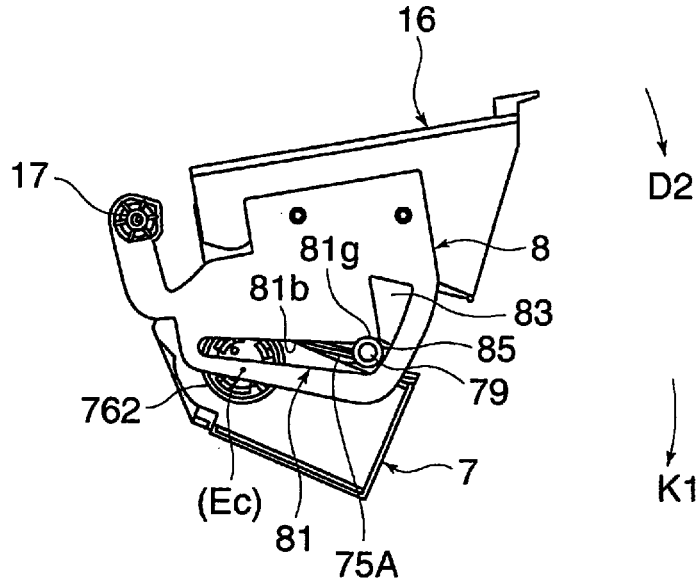

Next, FIGS. 20A and 20B show states in which the movable holder 75A of the mounting and holding frame 7 is displaced from the detachment operating position to the primary mounting completed position in association with the closing operation of the opening/closing cover 16 in the full color mode. FIG. 20A shows a state occurring in a halfway stage of the displacement, and FIG. 20B shows a state occurring when the opening/closing cover 16 is closed completely and the movable holder 75A is displaced to the primary mounting completed position.

As this occurs, when the opening/closing cover 16 is caused to swing about the shaft 17 as the fulcrum in a direction indicated by an arrow D2 to be closed, as is shown in FIG. 20A, the projecting pin 79 moves away from the primary waiting space portion 82 of the guide groove 81 and is then guided so as to be brought into contact with the secondary guide portion 81*b*. Then, the projecting pin 79 receives a force (F2) generated by the closing operation of the opening/closing cover 16 and directed downwards while the projecting pin 79 is brought into contact with the secondary guide portion 81*b* and moves by a required guiding distance K1. By doing so, the movable holder 75A swings about the rotation support device 762 which constitutes the rotation support point (Ec) thereof in a direction indicated by an arrow K1.

Then, when the opening/closing cover 16 swings to a restricting position where the opening/closing cover 16 is closed completely, as is shown in FIG. 20B, the projecting pin 79 moves as far as the boundary portion 81*g* which constitutes a termination point of the secondary guide portion 81*b* of the guide groove 81, then moves so as to pass through the narrow portion 85 to fall in the secondary waiting space portion 83 and stops thereat. The projecting pin 79 receives a force (F3>F2) to which a force resulting from frictional resistance produced when the projecting pin 79 passes through the narrow portion 85 is added as a result of the closing operation of the opening/closing cover 16. As a result, the movable holder 75A is displaced to the primary mounting completed position (FIGS. 8, 14, 15). The developer recovery container 6 which is held in the movable holder 75A which is now located in the primary mounting completed position can perform a recovery operation of unnecessary substances such as developers which are removed by the belt cleaner 35 (FIGS. 4, 14).

Figure 21A:
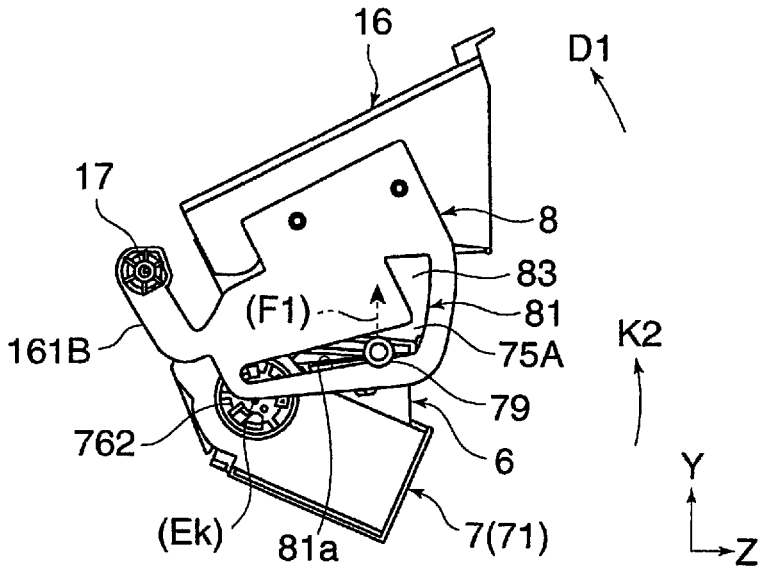
Figure 21B:
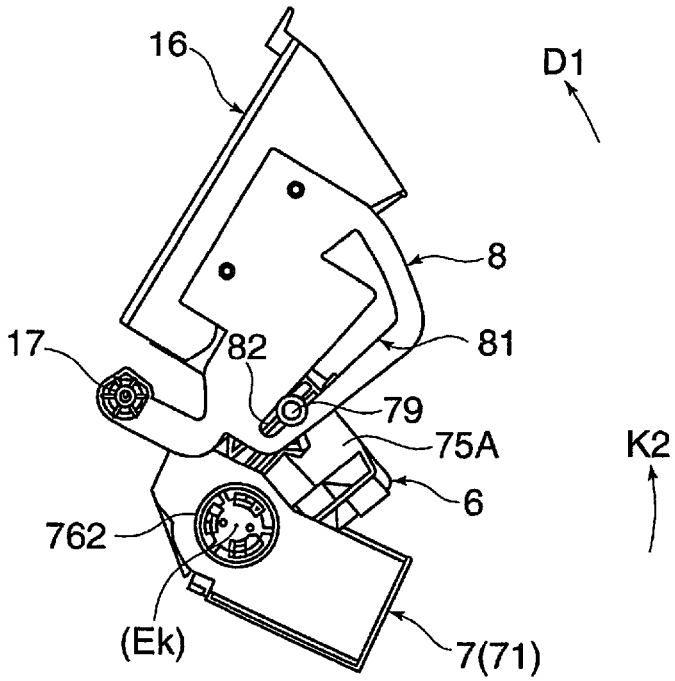

On the other hand, FIGS. 21A and 21B show states in which the movable holder 75A of the mounting and holding frame 7 is displaced from the secondary mounting completed position to the detachment operating position in association with the opening operation of the opening/closing cover 16 in the monochrome mode. FIG. 21A shows a state occurring in a halfway stage of the displacement, and FIG. 21B shows a state occurring when the opening/closing cover 16 is opened completely and the movable holder 75A is displaced to the detachment operating position.

As this occurs, when the opening/closing cover 16 is caused to swing in a direction indicated by an arrow D1 to be opened, as with the full color mode, the projecting pin 79 moves out of the secondary waiting space portion 83 of the guide groove 81 and is then guided into the primary guide portion 81*a*, as is shown in FIG. 21A. Then the projecting pin 79 receives a force (F1) generated by the opening operation of the opening/closing cover 16 and directed upwards while the projecting pin 79 is brought into contact with the primary guide portion 81*a* and moves by a required guiding distance. By doing so, the movable holder 75A swings about the rotation support device 762 which constitutes the rotation support point (Ec) thereof in a direction indicated by an arrow K2.

Then, when the opening/closing cover 16 swings to the restricting position where the opening/closing cover 16 is opened completely, as is shown in FIG. 21B, the projecting pin 79 moves as far as the primary waiting space portion 82 of the guide groove 81 and stops thereat. In this case, the projecting pin 79 comes to a stop directly before the turning portion 81*c* and hence, the projecting pin 79 does not come into contact with the turning portion 81*c*. As a result of this, the movable holder 75A is displaced to the detachment operating position (FIGS. 6, 12). As this occurs, too, as with when the full color mode is selected, a detaching operation of the developer recovery container 6 can be performed on the movable holder 75A which is now in the detachment operating position (FIG. 12). In FIG. 21B, too, a state is shown in which the developer recovery container 6 is removed.

Figure 22A:
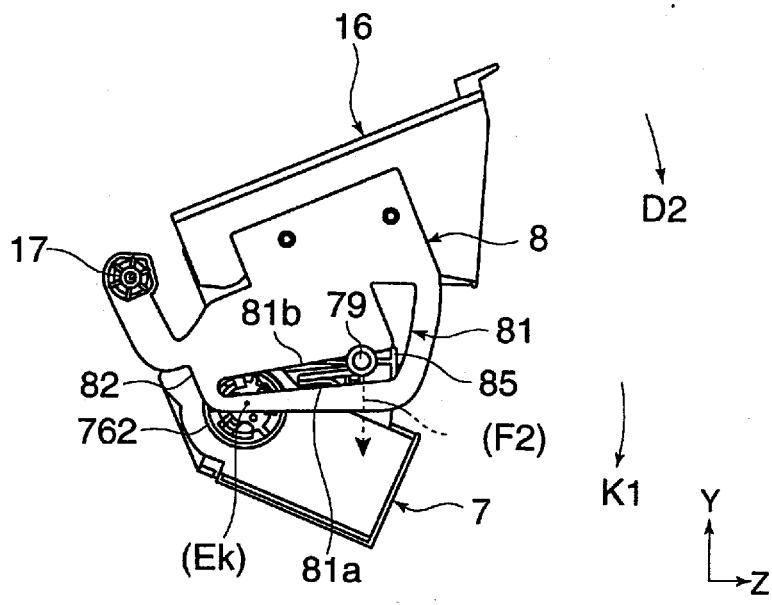
Figure 22B:
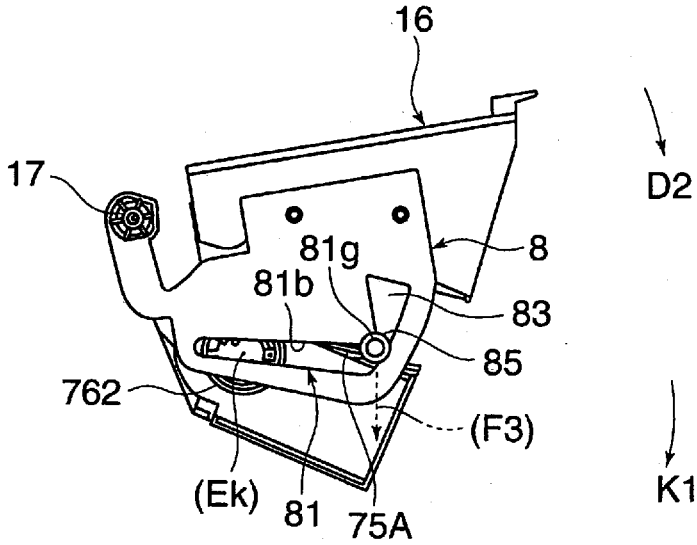

Next, FIGS. 22A and 22B shows states in which the movable holder 75A of the mounting and holding frame 7 is displaced from the detachment operating position to the primary mounting completed position in association with the closing operation of the opening/closing cover 16 in the full color mode. FIG. 22A shows a state occurring in a halfway stage of the displacement, and FIG. 22B shows a state occurring when the opening/closing cover 16 is closed completely and the movable holder 75A is displaced to the secondary mounting completed position.

As this occurs, when the opening/closing cover 16 is caused to swing in a direction indicated by an arrow D2 to be closed, as is shown in FIG. 22A, the projecting pin 79 moves away from the primary waiting space portion 82 of the guide groove 81 and is then guided so as to be brought into contact with the secondary guide portion 81*b*. Thereafter, the projecting pin 79 comes into contact with the secondary guide space portion 81*b* and moves by the required guiding distance K1, receiving a force (F2) generated by the opening operation of the opening/closing cover 16 and directed upwards. By doing so, the movable holder 75A swings about the rotation support device 762 which constitutes the rotation support point (Ec) thereof in a direction indicated by an arrow K1.

As is shown in FIG. 22B, when the opening/closing cover 16 is closed further, the projecting pin 79 moves as far as the boundary portion 81*g* which constitutes the termination point of the secondary guide portion 81*b* of the guide groove 81 and then reaches the narrow portion 85. In this stage, the opening/closing cover 16 has not yet reached the restricting position where the opening/closing cover 16 is closed completely. The projecting pin 79 receives a force (F3>F2) to which a force resulting from frictional resistance produced when the projecting pin 79 passes through the narrow portion 85 is added as a result of the closing operation of the opening/closing cover 16. By receiving the force F3, the projecting pin 79 moves so as to pass through the narrow portion 85 to fall in the secondary waiting space portion 83 and comes to a stop. In this stage, the opening/closing cover 16 has not yet reached the restricting position where the opening/closing cover 16 is closed completely.

As a result, the movable holder 75A can be displaced to the secondary mounting completed position in an ensured fashion (FIGS. 8, 14, 15). The developer recovery container 6 which is held in the movable holder 75A which is now located in the secondary mounting completed position can perform a recovery operation of unnecessary substances such as developers which are removed by the belt cleaner 35 (FIGS. 4, 14).

Other Exemplary Embodiments

In the first exemplary embodiment, the constituent components of the developer recovery container 6 which are involved in the detachment thereof are illustrated as the objects that are linked together by use of the connection frame 8. However, other constituent components than those which are involved in the detachment of the developer recovery container 6 can be taken as the objects that are linked together by the connection frame 8. For example, a detachment unit 21 can also be adopted which includes a photosensitive drum 22 which is supported so that its mounting completed position can be changed between the full color mode and the monochrome mode.

In the first exemplary embodiment, the groove configured by the single continuous groove is illustrated as the guide groove 81 of the connection frame 8. However, the configuration of the groove can also be modified. For example, a configuration can be adopted in which a primary guide portion 81*a* and a secondary guide portion 81*b* are formed into independent grooves (passages), and the two passages are connected by a primary waiting space portion 82 and a secondary waiting space portion 83. In addition, the guide groove 81 does not have to be the one which penetrates through the connection frame 8 as illustrated in the first exemplary embodiment. Therefore, a guide groove may be adopted which does not penetrate the connection frame 8.

In addition to those exemplary embodiments that have been described above, according to the invention, there can be provided a type of image forming apparatus which does not use an intermediate transfer unit (a so-called image forming apparatus adopting a direct transfer approach in which a recording sheet P is transported so as to pass through a primary transfer position of each image forming unit so that a toner image is directly transferred on to the recording sheet). In addition, as image forming apparatus to which the invention is to be applied, there can be taken image forming apparatuses such as a printer, a photocopier and a facsimile machine, as well as image forming apparatuses in which various functions are combined which are represented by a printing function, a photocopying function and a facsimileling function (a function to input, output, transmit and receive an image).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus main body that comprises an opening portion;

a detachable constituent component that is detachably mounted in an interior of the apparatus main body through the opening portion;

an opening/closing part that opens/closes the opening portion of the apparatus main body when the detachable constituent component is attached/detached;

a holding part that holds the detachable constituent component so that the detachable constituent component is displaced to a detachment operating position and primary and secondary mounting completed positions as a result of linking with opening/closing operations of the opening/closing part, wherein the holding part changes positions between the primary mounting completed position and the secondary mounting completed position by being moved in the interior of the apparatus main body; and a connection part that is provided on the opening/closing part and in which a guide groove is formed which guides a projecting portion provided on the holding part when the detachable constituent component is being displaced from the detachment operating position to the primary or secondary mounting completed position, wherein the guide groove of the connection part includes a narrow portion through which the projecting portion is caused to pass while the detachable constituent component is being displaced from the detachment operating position to the primary or secondary mounting completed position, and wherein the narrow portion has a groove width which is narrower than an outer dimension of the projecting portion.

2. The image forming apparatus according to claim 1, wherein the guide groove of the connection part is shaped to have:

a waiting space portion where the projecting portion can be put into a waiting state with the opening/closing part closed even when the holding part resides in either of the primary mounting completed position and the secondary mounting completed position;

a primary guide portion with which the projecting portion is brought into contact so as to be guided to move out of the waiting space portion when the opening/closing part is opened and;

a secondary guide portion with which the projecting portion is brought into contact so as to be guided to return into the waiting space portion when the opening/closing part is closed, wherein the narrow portion is formed at a boundary portion of the secondary guide portion and the waiting space portion.

3. The image forming apparatus according to claim 1, further comprising:

a plurality of image carriers on which images made from developers are formed;

an intermediate transfer body that enables the images formed on the respective image carriers to be transferred thereon for transport to a final transfer position;

a cleaner unit that removes developers which remain on the intermediate transfer body after the intermediate transfer body has passed through the final transfer position; and a recovery container that recovers the developers that have been removed by the cleaner unit, wherein the detachable constituent component is the recovery container, the holding part is a container holding portion that holds the recovery container, the primary mounting completed position of the container holding portion is set as a position where the intermediate transfer body is brought into contact with all the plurality of image carriers, and the secondary mounting completed position of the container holding portion is set as a position where the intermediate transfer body is spaced away from part of the plurality of image carriers.

* * * * *